US012745864B1

(12) United States Patent
Spaulding et al.

(10) Patent No.: US 12,745,864 B1
(45) Date of Patent: Sep. 29, 2026

(54) MODULAR FABRIC POD FOR CHANGING SEASONS AND FASHION TRENDS IN ROBOTIC MICRO-FULFILLMENT

(71) Applicant: Amazon Technologies, Inc., Seattle, WA (US)

(72) Inventors: Arianne Etta Spaulding, Brookline, MA (US); John Mark Waldron, Wayland, MA (US); Mary J Hester, Somerville, MA (US); Victoria Joy Asman, Ipswich, MA (US)

(73) Assignee: Amazon Technologies, Inc., Seattle, WA (US)

( * ) Notice: Subject to any disclaimer, the term of this patent is extended or adjusted under 35 U.S.C. 154(b) by 721 days.

(21) Appl. No.: 18/122,034

(22) Filed: Mar. 15, 2023

(51) Int. Cl.

| | |
|---|---|
| ***A47F 7/19*** | (2006.01) |
| ***A47F 3/06*** | (2006.01) |
| ***A47F 5/00*** | (2006.01) |
| *A47F 3/02* | (2006.01) |

(52) U.S. Cl.
CPC ..... *A47F 7/19* (2013.01); *A47F 3/063* (2013.01); *A47F 5/0081* (2013.01); *A47F 3/02* (2013.01); *A47F 3/06* (2013.01); *A47F 5/0018* (2013.01); *A47F 5/005* (2013.01)

(58) Field of Classification Search
CPC .. A47F 7/19; A47F 3/063; A47F 3/043; A47F 3/00; A47F 3/004; A47F 3/02; A47F 3/0404; A47F 3/06; A47F 3/14; A47F 5/00; A47F 5/0018; A47F 5/0025; A47F 5/005; A47F 5/0081; A47F 5/10
See application file for complete search history.

(56) References Cited

U.S. PATENT DOCUMENTS 1,015,722 A * 1/1912 Bezold ..... A47B 63/02 312/323
1,151,491 A * 8/1915 MacDaniel ..... A47B 43/04 312/258
1,320,392 A * 11/1919 Hirschman ..... A47L 23/16 15/265

(Continued)

FOREIGN PATENT DOCUMENTS

JP 02119804 A 5/1990
JP 10304944 A 11/1998

OTHER PUBLICATIONS

U.S. Appl. No. 18/122,021, "Lockable Fabric-Drawers for Inventory Holder", Filed Mar. 15, 2023, 43 pages.

*Primary Examiner* — Devin K Barnett
(74) *Attorney, Agent, or Firm* — Kilpatrick Townsend & Stockton LLP

(57) ABSTRACT

An inventory holder assembly can include a fabric sleeve and a simple bin. The fabric sleeve can be installed on a frame. The fabric bin can include a plurality of compartments, and engagement tabs can be disposed within a first compartment of the plurality of compartments. Each compartment can include a set of mounts arranged to facilitate modular arrangement of bins. The simple bin can be disposed in the first compartment. The simple bin can include a base releasably coupled to the set of mounts of the first compartment, and a tiltable door pivotably attached to the base. The tiltable door can include a releasable fastener engageable with the engagement tabs of the first compartment to securely close the simple bin and disengageable by tilting the tiltable door to open the simple bin.

12 Claims, 13 Drawing Sheets

(56) References Cited

U.S. PATENT DOCUMENTS 1,428,957 A * 9/1922 Hall ..... A47B 67/02 108/38
2,015,315 A * 9/1935 Mcmackin ..... B60R 15/04 297/146
2,233,488 A * 3/1941 Powell ..... B65D 5/742 229/125.42
2,275,373 A * 3/1942 Barrett ..... A47B 63/02 312/300
2,513,595 A * 7/1950 Stewart ..... G07F 11/30 221/256
2,516,116 A * 7/1950 Hammond ..... A47B 81/067 312/901
2,686,644 A * 8/1954 Pratt ..... A62C 35/20 248/90
2,803,390 A * 8/1957 Mackay ..... B65D 5/722 248/300
2,886,232 A * 5/1959 Leone ..... B65D 5/722 229/122.1
2,944,555 A * 7/1960 Peel ..... B65D 85/1045 206/268
2,975,890 A * 3/1961 Block ..... B65D 85/109 206/92
3,161,341 A * 12/1964 Farquhar ..... B65D 5/722 229/122.1
3,593,908 A * 7/1971 Desmond ..... B65D 5/16 229/122
3,747,833 A * 7/1973 Robinson ..... B65D 5/721 221/305
3,909,078 A 9/1975 Riley
3,944,128 A * 3/1976 Hogan ..... B65D 5/722 229/122
4,186,978 A * 2/1980 Thomson ..... F25D 23/04 211/80
4,303,158 A * 12/1981 Perkins ..... A45C 11/24 312/902
D287,800 S * 1/1987 Lance ..... D6/559
5,259,631 A * 11/1993 Brande ..... A45C 11/00 229/120.19
5,392,951 A 2/1995 Gardner et al.
5,458,272 A * 10/1995 Ward-Weber ..... B65D 5/10 229/122.1
5,542,758 A * 8/1996 Brown ..... A47B 61/00 211/85.3
5,630,537 A * 5/1997 Sciacca ..... A01K 97/06 224/920
5,746,369 A * 5/1998 McDermott ..... B65D 5/722 221/45
6,113,202 A * 9/2000 Germano ..... B25H 1/12 312/244
6,189,778 B1 * 2/2001 Kanter ..... B65D 5/001 229/172
6,431,093 B1 * 8/2002 Hansen ..... B60R 3/005 182/84
6,682,158 B2 1/2004 Lai
6,702,411 B2 3/2004 Helver
6,923,516 B2 8/2005 Sheng-bin
6,951,300 B2 * 10/2005 Caille ..... B65D 5/5445 229/242
7,044,178 B1 * 5/2006 Campbell ..... B25H 1/12 144/286.5
7,089,872 B2 * 8/2006 Wintermute, II ..... A47F 5/116 108/165
7,121,452 B2 * 10/2006 Boriani ..... B65D 85/1072 229/243
7,204,406 B2 * 4/2007 Bone ..... B65D 5/548 229/122
D544,275 S * 6/2007 Tanus ..... D6/555
7,431,410 B2 10/2008 Sato et al.
7,481,014 B2 * 1/2009 Milburn ..... A47B 46/005 40/724
D680,859 S * 4/2013 Levy ..... D9/423
D697,793 S * 1/2014 Levy ..... D9/423
8,657,126 B1 * 2/2014 Loftin ..... A47F 1/087 211/59.2
8,789,704 B2 * 7/2014 Nowak ..... B65D 5/724 229/122
8,844,798 B2 * 9/2014 Linkel ..... B65D 5/722 229/230
8,919,894 B1 * 12/2014 Pachmayr ..... A47B 46/005 312/7.2
8,998,011 B2 4/2015 Zhu
9,169,039 B2 * 10/2015 Freeman ..... B65D 5/722
9,237,815 B2 * 1/2016 Smith ..... G07F 11/16
9,259,082 B2 2/2016 Barre et al.
9,961,994 B2 5/2018 Rivera
D866,318 S * 11/2019 Gallimore ..... D7/637
10,506,877 B1 * 12/2019 Edwards, II ..... A47B 61/04
10,786,075 B1 9/2020 Ghiorghie et al.
D917,208 S * 4/2021 Pachmayr ..... D6/671.1
11,109,676 B2 9/2021 Bantle et al.
11,174,068 B2 * 11/2021 Beavor ..... A01K 39/0125
12,465,156 B1 * 11/2025 Spaulding ..... A47F 7/19
2004/0104649 A1 6/2004 Muller et al.
2005/0057910 A1 * 3/2005 Schnurr ..... A47B 46/005 361/797
2006/0103279 A1 5/2006 Lai
2009/0273259 A1 * 11/2009 Whitney ..... A47B 88/40 312/334.44
2012/0299454 A1 11/2012 Sabounjian
2013/0233819 A1 9/2013 Kwo
2014/0054249 A1 * 2/2014 Loftin ..... A47F 1/087 211/59.2
2017/0238700 A1 * 8/2017 Davis ..... A47B 43/04

* cited by examiner

MODULAR FABRIC POD FOR CHANGING SEASONS AND FASHION TRENDS IN ROBOTIC MICRO-FULFILLMENT

BACKGROUND

Micro-fulfilment centers such as retailers often store and sell wearables (e.g., clothing, shoes, etc.) or other home goods to be delivered to a customer. At such centers, wearables or home goods can be stored in different ways such as rolled clothes, garments on hangers, and shoe boxes. Clothing and other items can be highly variable due to changing seasons, styles, and trends. In addition, different clothing types may have differing characteristics that may prompt being stored separately. So, if there is a season with more hung garments, a retailer either may tend to overfill hang bins and under-utilize other bins, or change out entire shelving units, which is costly and inefficient.

In many instances, an inventory holder may include drawers rather than typical bins as drawers can allow an associate to look down at labels and sort through clothing. However, if a drawer is not closed when a shelving unit is moved, the drawers may extend out of the shelving unit and increase the likelihood of interference with other elements in system.

BRIEF DESCRIPTION OF THE DRAWINGS

Various embodiments in accordance with the present disclosure will be described with reference to the drawings, in which.

DETAILED DESCRIPTION

Figure 1:
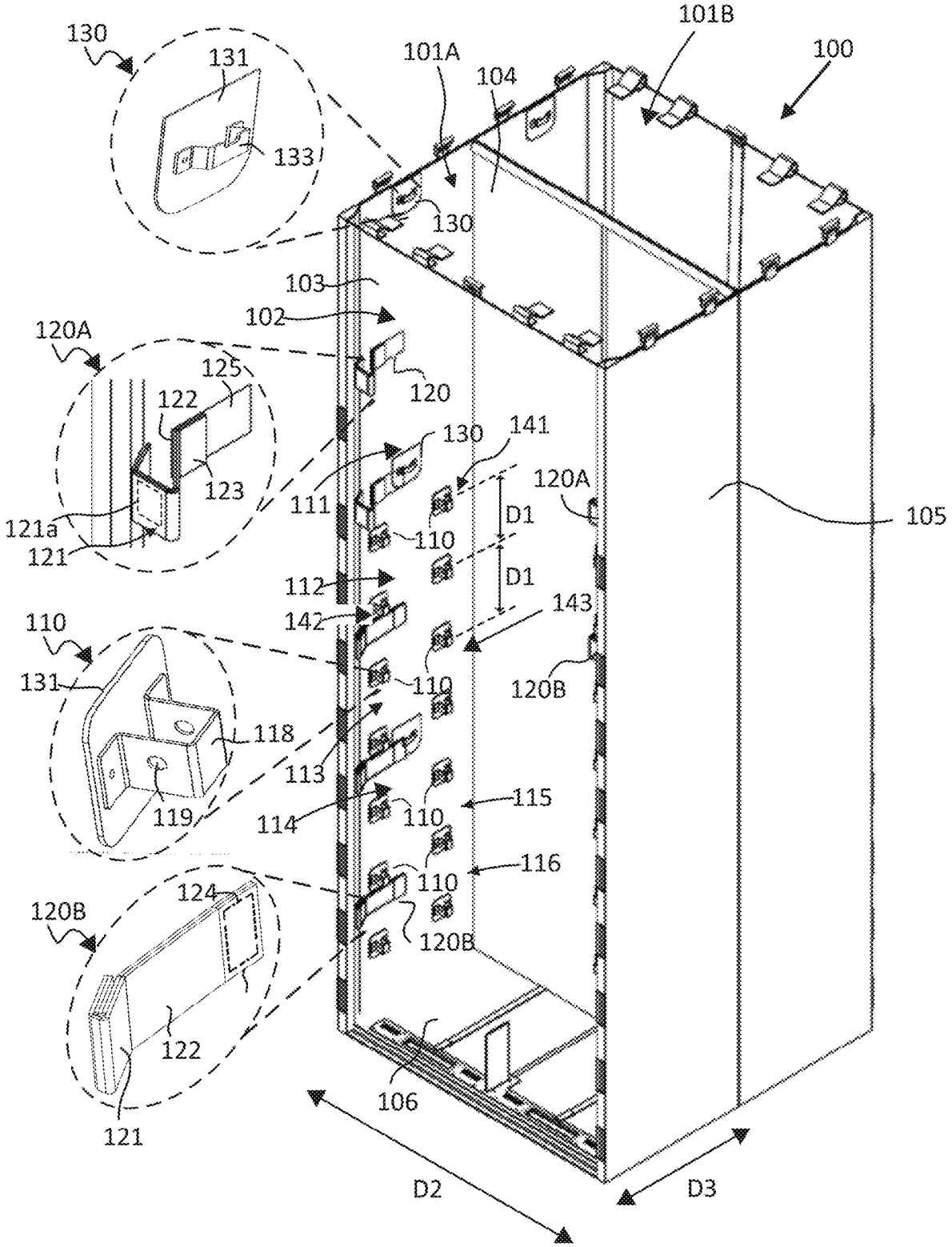
FIG. 1 illustrates an isometric view of a fabric sleeve in accordance with various embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

One challenge in inventory management e.g., at retailers, can be handling of a changes in materials as seasons and trends change. An inventory holder with fixed storage structure may be not suited to efficiently accommodate variability in storage stemming from changing seasonal and fashion trends. In such fixed inventory holders, bins are constrained to hold only one type of wearables (e.g., rolled clothing, shoes, or hung clothing). The present disclosure describes an inventory holder system that facilitates modularity such that storage sites (e.g., at retailers) can swap bins in and out as needed with changing seasons and trends. The inventory holder system can include an interchangeable fabric sleeve configured to accommodate different types of bins (e.g., a simple bin, a drawer bin, or a hanger bin). Depending on the seasonal trends and/or other changes in demand for different storage types, a fabric sleeve configuration can be changed to a different configuration to accommodate relevant bins to make efficient use of storage e.g., maximize use of storage space of an inventory holder.

Accordingly, in an aspect of the present disclosure, an inventory holder can include a frame, a fabric sleeve installed on a frame, and a drawer bin insertable in the fabric sleeve. The fabric sleeve may include multiple compartments (e.g., vertically disposed along a z-direction). Each compartment may include set of mounts. The mounts of a particular compartment can be coplanar (e.g., in a horizontal plane or x-y plane) to keep the drawer bin leveled.

In many embodiments, the drawer bin assembly can be coupled to the set of mounts of a compartment of the fabric sleeve. The drawer bin assembly may include a drawer bin biased to open. For example, the drawer bin may be coupled to a biaser (e.g., an elastic band) to extend more than halfway out or fully extend from the compartment of the fabric sleeve to achieve an open state. Also, the drawer bin may be pushed (e.g., by an operator) against the biaser to stow away and lock the drawer bin in place within the compartment of the fabric sleeve. This way, the drawer bin can be opened or closed single handedly, e.g., operated with one hand while another hand holds an item removed from—or to be inserted into—the drawer bin. When open, items within the drawer bin can be easily accessed. When closed, the drawer bin stays locked or secured so it does not bump into or interfere with other objects.

In many embodiments, the drawer bin of the drawer bin assembly may include a base with a locking element (e.g., a locking projection) and side walls extending from the base to form an open-box or drawer to receive items therein. The drawer bin assembly can further include a shelf releasably coupled within the compartment of the fabric sleeve. The shelf may include shelf brackets configured to align with and releasably couple with the set of mounts of the compartment of the fabric sleeve. The shelf may also include a lock opening configured to engage with the locking projection of the drawer bin and secure the drawer bin within the compartment of fabric sleeve in a closed state. As an example, the locking projection of the drawer bin may be an angled plate and the lock opening of the shelf may include a corresponding angled edge or protrusion configured to engage with angled plate. The drawer bins may be sized such that one compartment can receive two drawer bins laterally adjacent to each other. The two bins can be operated independently.

The biaser can be an elongate member coupled to the drawer bin and the shelf. The biaser may arranged to be in tension when the bin is in closed state. Hence, when the bin is unlocked, the biaser can cause the drawer bin to automatically open without additional human interaction. For example, a first end portion of the biaser can be coupled to a front portion of the shelf and a second end portion can be coupled to a back portion of the drawer bin. So, when the drawer bin is locked with the shelf, the biaser is in tension. When unlocked from the shelf, the biaser pushes out the drawer bin to fully extend from the compartment fabric sleeve. In one example, the second end of the biaser may be coupled to a back side wall of the drawer bin. In another example, the second end may be coupled to a side wall (e.g., a left side wall or a right side wall) of the drawer bin.

According to another aspect of the present disclosure, a method for installing a drawer bin assembly within a fabric sleeve is provided. The method involves releasably coupling a shelf within a compartment of a fabric sleeve, inserting or positioning the drawer bin over the shelf, and coupling a biaser to the drawer bin and the shelf. For example, the method can include releasably coupling a shelf within a compartment of a fabric sleeve, where the shelf may include a lock opening. The drawer bin may include a locking projection configured to couple with the lock opening of the shelf and lock the drawer bin to the shelf. The biaser can be coupled to the drawer bin and the shelf such that the drawer bin is biased to extend more than halfway out with respect to the shelf when the drawer bin is unlocked from the shelf In many embodiments, releasably coupling the shelf may include: aligning shelf brackets located at a bottom of the shelf with a set of mounts (e.g., coplanar mounts) of the compartment; and securing each of the shelf brackets to a corresponding mount of the set of mounts via a coupling pin. To remove the drawer bin, the coupling pin can be removed and the shelf can be separated from the mounts. Once the compartment is empty, another bin type with similar mounting features can be inserted in place of the drawer bin. This way, various configurations of the fabric sleeve can be achieved to optimize space use as fashion trends or seasonal trends change.

In many embodiments, the method can include coupling a first end of the biaser to a front portion of the shelf; and coupling a second end of the biaser to a back portion of the drawer bin. This way, when the drawer bin is locked with the shelf, the biaser is in tension. Also, when unlocked from the shelf, the biaser pushes out the drawer bin to automatically extend out from the compartment. Unlocking the drawer bin from the shelf can be done single-handedly and items stored within the drawer bin can be easily accessed. Similarly, moving the drawer bin against the biaser until the drawer bin is locked with the shelf can be done single-handedly.

According to an aspect of the present disclosure, an inventory holder assembly may include a frame, and a fabric sleeve installed on the frame, and a simple bin disposed in the fabric sleeve. The fabric sleeve can include multiple compartments (e.g., vertically spaced) that can be configured or reconfigured to receive different types of bins. For example, each compartment can include a set of mounts arranged to facilitate modular arrangement of bins. The fabric sleeve may include engagement tabs or retainers disposed within a compartment of the fabric sleeve.

In many embodiments, the simple bin can be disposed in the compartment (e.g., a first compartment) of the fabric sleeve. The simple bin may include a base secured to the set of mounts of the compartment. The simple bin may include a tiltable door pivotably attached to the base. The tiltable door can include a fastener engageable with the engagement tabs of the first compartment to securely close the simple bin and is disengageable by tilting the tiltable door to open the simple bin. The tiltable door only partial opens to trigger interference signals to avoid accidental bumping or interfering with objects or other inventory holders.

In some embodiments, the compartments of the fabric sleeve can further include a second compartment can be configured to include a hanger rod and a hanger bin, having larger dimension (e.g., height) than the simple bin. The second compartment can also include the engagement tabs. In some embodiments, a third compartment can be configured to receive at a drawer bin assembly. The set of mounts can be vertically equally spaced within the fabric sleeve but still accommodate bins of different sizes (e.g., different heights). As an example, the first compartment can have dimensions to receive a single simple bin, the second compartment can have dimensions equivalent to two simple bins, and the third compartment can have dimensions to receive two drawer bins. Each of the first, the second, and the third compartment can have same width.

In many embodiments, each of the retainers or engagement tabs can include a magnetic coupler and a rigid plate. Each of the engagement tabs can be configured to orient the magnetic coupler parallel to the tiltable door of the simple bin to facilitate engagement of the tiltable door when closed. The rigid plate is orientated to provide structural support to the magnetic coupler. Each of these retainers or engagement tabs can be a retractable element including an adjustable strip to stow away a respective retractable engagement tab to create space to receive one or more drawer bins within the first compartment, for example.

The simple bin can further include shelf brackets configured to securely couple a bottom surface of the simple bin to the set of mounts of the fabric sleeve. Each of the compartments can be configured to receive a bin selected from a simple bin, a hanger bin, or a drawer bin. Each bin may include a door configured to remain within an interference zone proximate to a front side of the fabric sleeve when a respective bin is closed. The tiltable door can be coupled to the fabric sleeve to limit an amount of opening of the simple bin.

In another aspect of the present disclosure, a simple bin is provided. The simple bin can include a base, and a tiltable door. The tiltable door can include a panel with a releasable fastener (e.g., a magnet or anchor) disposed along a side portion of the panel. A bottom edge of the tiltable door can be pivotably coupled along a front edge of the base. The simple bin can further include collapsible connectors attached to and extending at least partially along the opposite side portions of panel toward the base. The simple bin can be in an open state, wherein the panel is configured to partially tilt with respect to the base while the collapsible connectors limit tilting of the panel to a specified degree. The simple bin can be in a closed state, wherein the panel is configured to stay closed via the releasable fastener (e.g., magnets) while the collapsible connectors are collapsed.

In many embodiments, each of the collapsible connectors can be an accordion connector having an arcuate length configured to limit tilting of the panel to the specified degree. The simple bin can include a divider couplable to the base. The base can include a top surface and the divider can be removably attached to the top surface of the base to divide a space above the top surface into a first storage portion and a second storage portion. Shelf brackets can be attached to a bottom surface of the base. The shelf brackets can be configured to securely couple the bottom surface of the simple bin to a set of mounts of a fabric sleeve.

In another aspect of the present disclosure, a method for assembling an inventory holder using a fabric sleeve is provided. The method can include accessing a fabric sleeve, installing the fabric sleeve on a frame, and inserting a simple bin in the fabric sleeve. The fabric sleeve can be configured to accommodate different types of bins. The fabric sleeve may include multiple compartments, where each compartment may include a set of mounts couplable to interchangeable bin structures defining which bin is receivable within each compartment thereby facilitating customizable the fabric sleeve. Further, the method can involve installing the fabric sleeve onto a frame to define an inventory holder to allow the inventory holder to receive a particular bin defined by the mounts of the fabric sleeve.

The method can further include inserting the simple bin into a first compartment of fabric sleeve. The interchangeable bin structures may include shelf brackets disposed at a bottom side of the simple bin and configured to couple with a first set of mounts of the first compartment. The inserting of the simple bin may include: aligning the shelf brackets of the simple bin with the first set of mounts of the first compartment of the fabric sleeve. The first compartment further may include retractable engagement tabs, and the simple bin may include a tiltable door. Accordingly, the simple bin can be assembled into the first compartment of the fabric sleeve such that the tiltable door is engageable or disengageable from the retractable engagement tabs of the first compartment.

In some embodiments, inserting the simple bin may include adjusting a retractable engagement tab of the first compartment to facilitate engagement of a door of the simple bin when closed. The retractable engagement tab may include a first portion configured to engage with a tiltable door of the simple bin and a second portion configured to provide structural support to the first portion, and where the first portion is alignable with the second portion or is orientable at an angle with the second portion. Adjusting the retractable engagement tab may include: orienting the first portion (e.g., including a magnetic coupler) of the retractable engagement tab in a vertical plane and orienting the second portion (e.g., including a rigid plate) at an angle with the first portion to support the orientation of the first portion.

In some example, the method may include: inserting a hanger bin into a second compartment of the fabric sleeve. The hanger bin can be larger than the simple bin. In some examples, the method can include inserting a drawer bin into a third compartment of the fabric sleeve. The drawer bin can be smaller than the simple bin. Inserting the drawer may include coupling (e.g., via shelf brackets) a shelf to a third set of mounts of the third compartment. Retractable engagement tabs of the third compartment can be stowing away to receive the drawer bin.

Advantageously, the fabric sleeve, its mounts, and interchangeable bin structures can facilitate customization of inventory holders to optimize space utilization without having to replace an entire inventory holder. For example, the compartments and mounts therein can be vertically spaced to accommodate different sized bins based on changing fashion or seasonal trends.

FIG. 1 illustrates an isometric view of a fabric sleeve 100 according to various embodiments. The fabric sleeve 100 can include a front opening 102 for receiving bins within a volume formed by sidewalls 103 and 105, a back wall 104, and a bottom wall 106. In the illustrated embodiment, the fabric sleeve 100 can include a first receiving portion 101A and a second receiving portion 101B. The second receiving portion 101B can be configured in the same or different manner to the first receiving portion 101A. The following description explains configuration of the first portion 101A as an example and for brevity, although similar or different configuration may be implemented in the second receiving portion 101B.

The fabric sleeve 100 can be divided into a plurality of compartments (e.g., 111, 112, 113, 114, 115, and 116). Each compartment can include a set of mounts (e.g., 110, 130) arranged to facilitate modular arrangement or rearrangement of bins and/or to maximize storage within the volume of the fabric sleeve 100. The set of mounts (e.g., 110) can be coupled to interchangeable bin structures (e.g., shelf brackets) for defining which bin is receivable within each compartment, thereby facilitating customization of the fabric sleeve to maximize storage even if storage demands change due to e.g., seasons, fashion treads, product lines, etc.

In many embodiments, the set of mounts can include one or more mounts 110 configured to releasably couple a bin within a compartment. As another example, the set of mounts can include one or more hanger mounts 130. The set of mounts 110, 130 can be attached to an inner surface of the walls 103, 104, and/or 105. For example, the mounts 110, 130 can attached to the inner surface of the walls 103, 104, and/or 105 by sewing, adhesive, fasteners, or other attachment techniques. Additionally or alternatively, the inner surfaces of the walls 103, 104, 105 can be used for installing tabs, or other bin installation features.

In some embodiments, a mount 110 can be or include a U-shaped element 118 with a pin hole 119 through the U-shape. The U-shaped element 118 can receive an interchangeable bin structure that can be releasably coupled in place by passing a pin through the pin hole 119. The mount 110 can be made of metal, plastic, or other rigid material to support a weight of a bin and items disposed therein. The U-shaped element 118 can be coupled to a mounting pad 131 using e.g., screw, rivet, adhesive, or other fasteners. The mounting pad 131 can be made of fabric, plastic, or other material that can be coupled (e.g., screwed, glued, etc.) to the fabric sleeve 100. It can be understood that the U-shaped mount is only an example of the mount 110 and other mounting structures that allow interchangeability and releasable attachment can be utilized.

In some embodiments, a mount 130 can be another U-shaped element 133 configured to receive a hook e.g., at ends of a hanger rod (see FIG. 2) so that the hanger rod can be supported within a compartment of the fabric sleeve. The U-shaped element 118 can be coupled to a mounting pad 131 using e.g., screw, rivet, adhesive, or other fasteners. The mount 110 can be made of metal, plastic or other rigid material. The mounting pad 131 can be made of fabric, plastic, or other material that can be coupled (e.g., screwed, glued, etc.) to the fabric sleeve 100.

In many embodiments, the set of mounts 110 can include horizontally spaced mounts that are arranged to be coplanar with one another within the fabric sleeve 100. In many embodiments, a subset set of mounts 110 can be coplanar and referred as a first set of coplanar mounts 141, a second set of coplanar mounts 142. For example, the first set of coplanar mounts 141 can include two mounts 110 horizontally spaced on the wall 103, one mount 110 located on the wall 104 (see FIG. 2), and two mounts 110 horizontally spaced on the wall 105 (obscured from view in FIG. 1 as being on an inside of the wall 105, but mirrored or otherwise similar to the arrangement shown on wall 103). The first set of coplanar mounts 141 can be vertically spaced from the second set of coplanar mounts 142 within the fabric sleeve 100. Furthermore, a third set of coplanar mounts 143 can be vertically spaced from the second set of coplanar mounts 142. In the illustrated embodiment, the vertical spacing can be the same e.g., distance D1 between the coplanar mounts 141, 142, and 143. In another example, however, the vertical spacing between coplanar mounts may be different. In some embodiments, the spacing D1 may corresponds to a size of a particular bin type (e.g., a drawer bin). In some embodiments, approximately twice the spacing D1 may correspond to another bin type (e.g., a simple bin). In some embodiments, approximately thrice the spacing D1 may correspond to yet another bin type (e.g., a hanger bin). Accordingly, a space or volume between coplanar mounts can correspond to a compartment of the plurality of compartments 111-116.

In many embodiments, the plurality of compartments can include a first compartment 111, a second compartment 112, a third compartment 113, a fourth compartment 114, a fifth compartment 115, and a sixth compartment 116. The first compartment 111 can have larger dimensions (e.g., three times vertical distance D1) than the second compartment 112. For example, the first compartment 111 can be configured to include a hanger rod (see FIG. 2 and FIG. 3) and receive a hanger bin (see FIG. 2). The second compartment 112 can have medium dimensions (e.g., two times vertical distance D1). The second compartment 112 can be configured to receive a simple bin (e.g., see FIG. 2 and FIG. 3). The third compartment 113 can have smaller dimensions (e.g., a distance D1) than the second compartment 112. The third compartment 113 can receive one or two drawer bins (see FIGS. 2 and 3). Each of the compartments 111-116 can have same width D2 and depth D3.

In many embodiments, the fabric sleeve 100 can include a plurality of engagement tabs or retainers 120 (also referred to as 120A or 120B) disposed within the plurality of compartments 111-116. An engagement tab 120 can be in an engagement mode (accordingly referred to as an engagement tab 120A) or in a stowed mode (accordingly referred to as an engagement tab 120B). Each of the engagement tabs 120 may be retractable. As such, the engagement tab 120A can be retracted into a compartment and stowed therein to create space for receiving a particular type of bin (e.g., a drawer bin) within the compartment. In some embodiments, the retractable engagement tab 120 can be an adjustable strip. The adjustable strip can include a releasable portion couplable to another strip 125 attached to the inner surface of the wall 103. The releasable portion 123 and the strip 125 can include hook and loop fasteners 124, or other releasable or length-adjusting structure to easily retract the engagement tab 120.

In some embodiments, the engagement tab 120 can include a first portion 121, a second portion 122, and the releasable portion 123 (see enlarged views 120A and 120B in FIG. 1). Each of the portions 121-123 can be pivotably coupled to each other so that one or more portions can be oriented as desired (e.g., in engagement mode or stow away mode). In an example, the engagement tab 120 can include a button, magnetic or other releasable retainer 121*a* (represented by dotted box). In the illustrated embodiment, the retainer 121*a* can include a magnetic coupler, and the second portion 122 can include a rigid or semi-rigid panel. The engagement tab 120 can be configured to orient the first portion 121 (e.g., the magnetic coupler or other retainer 121*a*) parallel to a door of a simple bin (see FIG. 2) to facilitate engagement with the door. The second portion 122 (e.g., the rigid panel) can be angularly oriented with respect to the first portion 121 to provide structural support to the retainer 121*a* and maintain the orientation of the first portion 121. For example, the first portion 121 may be oriented parallel to a closed door position of a simple bin (see FIG. 3).

The present disclosure is not limited to above discussed disposition of the magnetic coupler. The magnetic coupler may correspond to a magnet or a material that can be engaged by magnet. A magnet can be in the engagement tab 120 or in the door 122, and a metal or another magnet can be in the other part.

Figure 2:
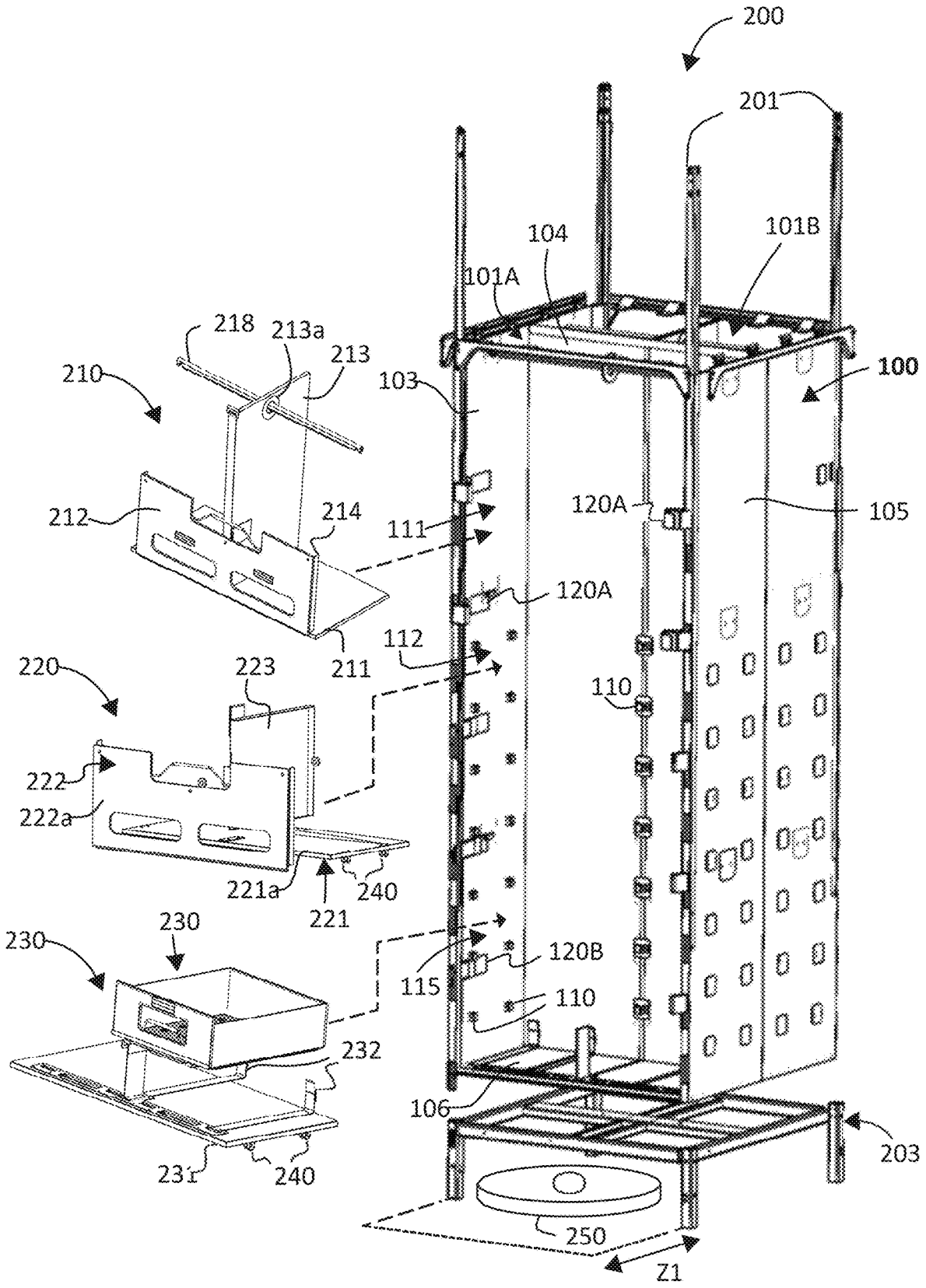
FIG. 2 illustrates a partially exploded view of an inventory holder including the fabric sleeve of FIG. 1.

FIG. 2 illustrates a partially exploded view of an inventory holder 200 employing the fabric sleeve 100 of FIG. 1. The inventory holder 200 includes the fabric sleeve 100 configured to couple to a frame. In the illustrated embodiment, a frame of the inventory holder 200 can include frame rods 201 and a base frame 203 couplable with the fabric 100 and/or with each of the frame rods 201. In some embodiments, the fabric sleeve 100 can include pockets or straps at corner edges of the fabric sleeve 100 through which the frame rods 201 can be passed and/or coupled to the fabric sleeve 100. Further, the bottom wall 106 of the fabric sleeve 100 can be coupled to the base frame 203. Accordingly, the frame 201, 203 provides structural support to the fabric sleeve 100 when assembled therewith. In some embodiments, a mobile drive unit 250 can be placed underneath the base frame 203 to elevate the inventory holder 200 off the ground and/or otherwise move the inventory holder 200 around as specified. Ensuring that the bins within the fabric sleeve 100 are closed may facilitate movement of the inventory holder 200 because an open bin may interfere with other inventory holders or other objects within the storage area.

Figure 14:
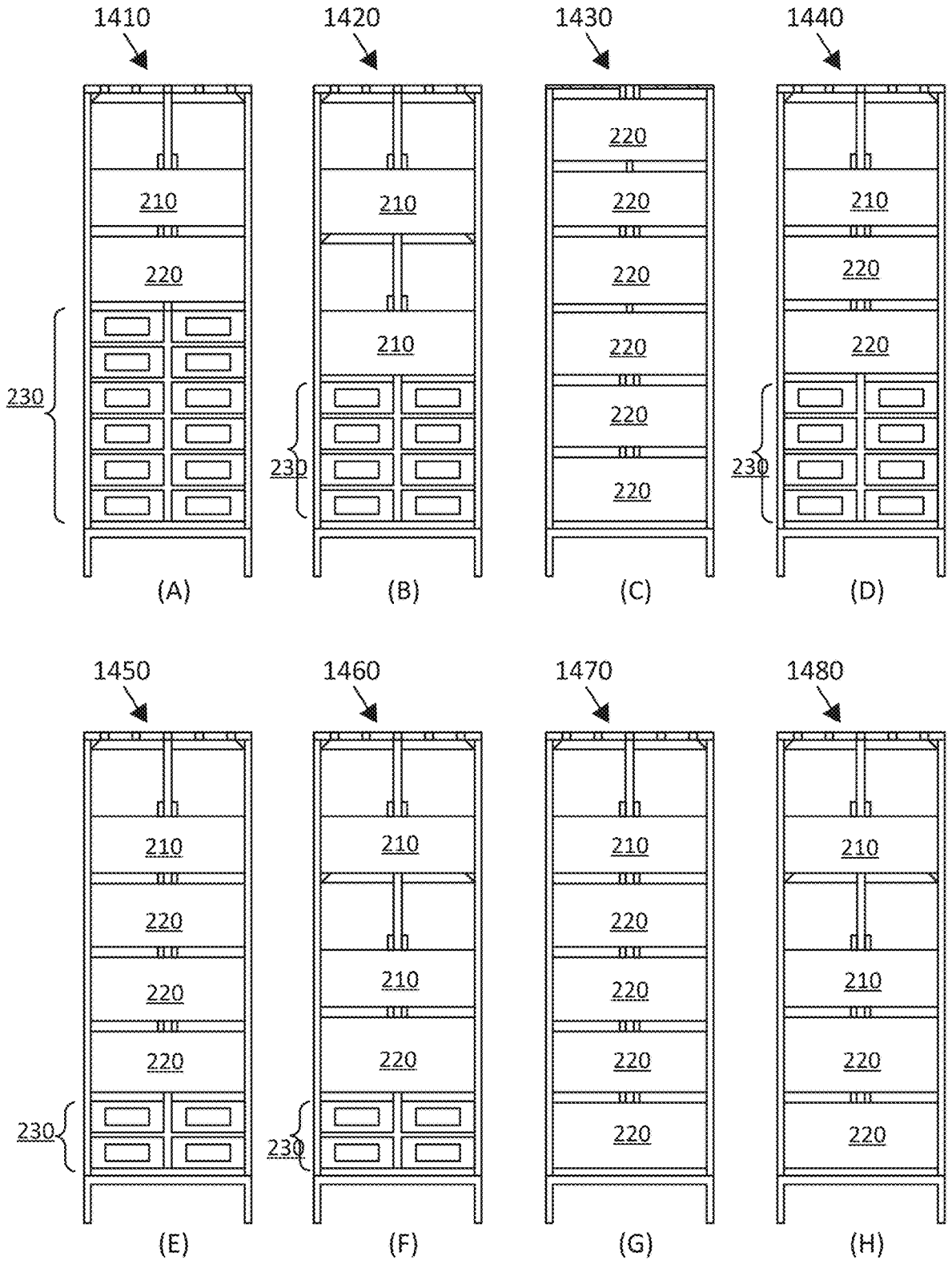
FIG. 14 illustrate views of different configurations of inventory holders achieved using the fabric sleeve of FIG. 1 in accordance with various embodiments.

The inventory holder 200 can receive, within the fabric sleeve 100, multiple bins, which may be of different types. For example, the different bin types can be a hanger bin 210, a simple bin 220, and a drawer bin 230. Although example in FIG. 2 shows three different types of bins being assembled in the fabric sleeve 100, the present disclosure is not limited to such configuration. For example, views (A)-(H) in FIG. 14 illustrate various examples of different configurations of the inventory holder 200 that can be achieved via the fabric sleeve 100 based on changes in fashion trends, seasons, etc. Accordingly, the fabric sleeve 100 can facilitate optimal use of a storage space in a cost effective and simple manner compared to a traditional inventory holder. For example, a traditional inventory holder may have fixed shelving and sizes which are not readily adjustable to maximize storage. In fact, an entire inventory holder may be swapped as to accommodate changes in storage requirements due to changes in fashion or seasons, which may entail significantly higher time and costs than may be involved for suitable reconfiguring in embodiments herein.

Figure 3:
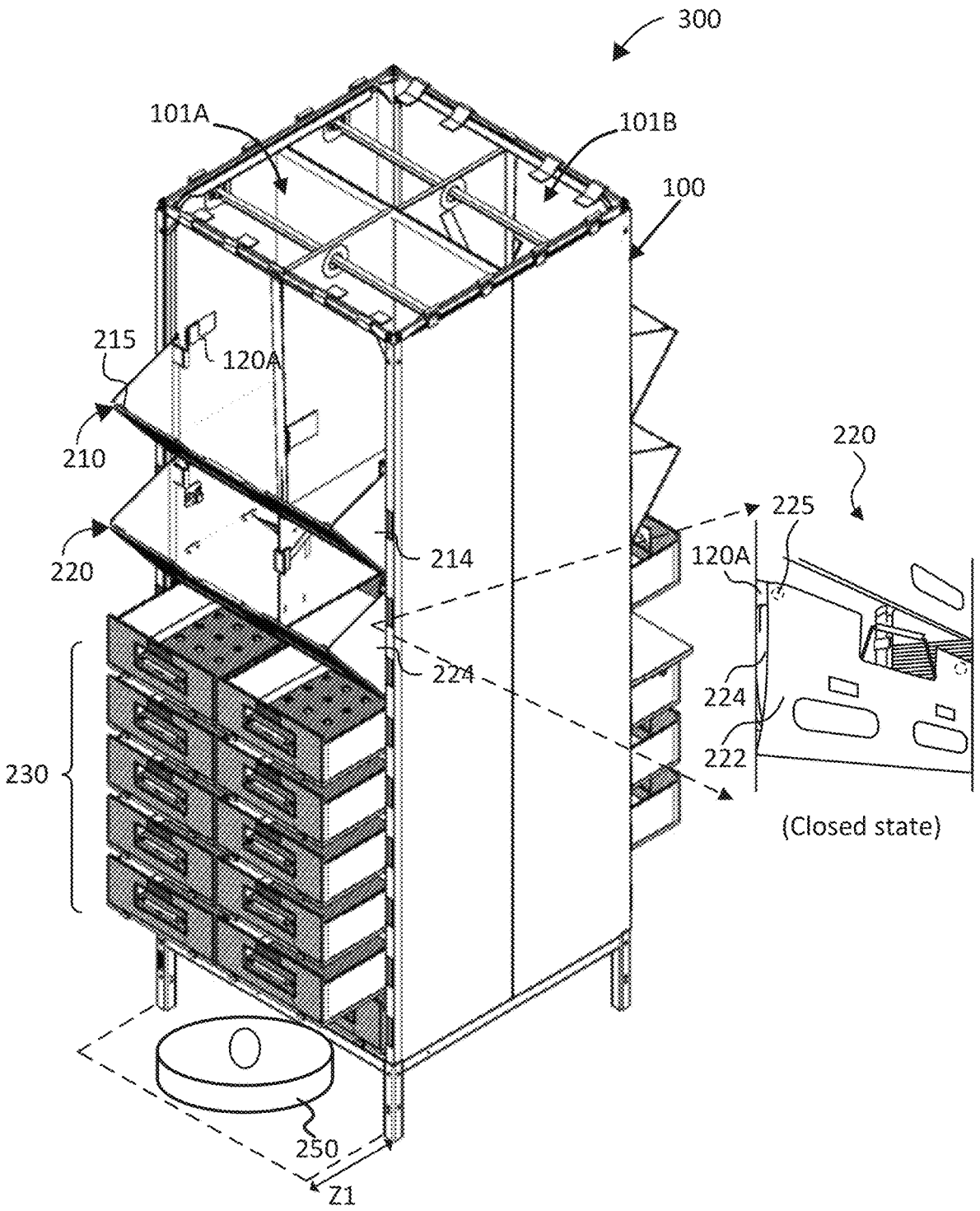
FIG. 3 illustrates an inventory holder including different types of bins in open state in accordance with various embodiments.
Figure 4:
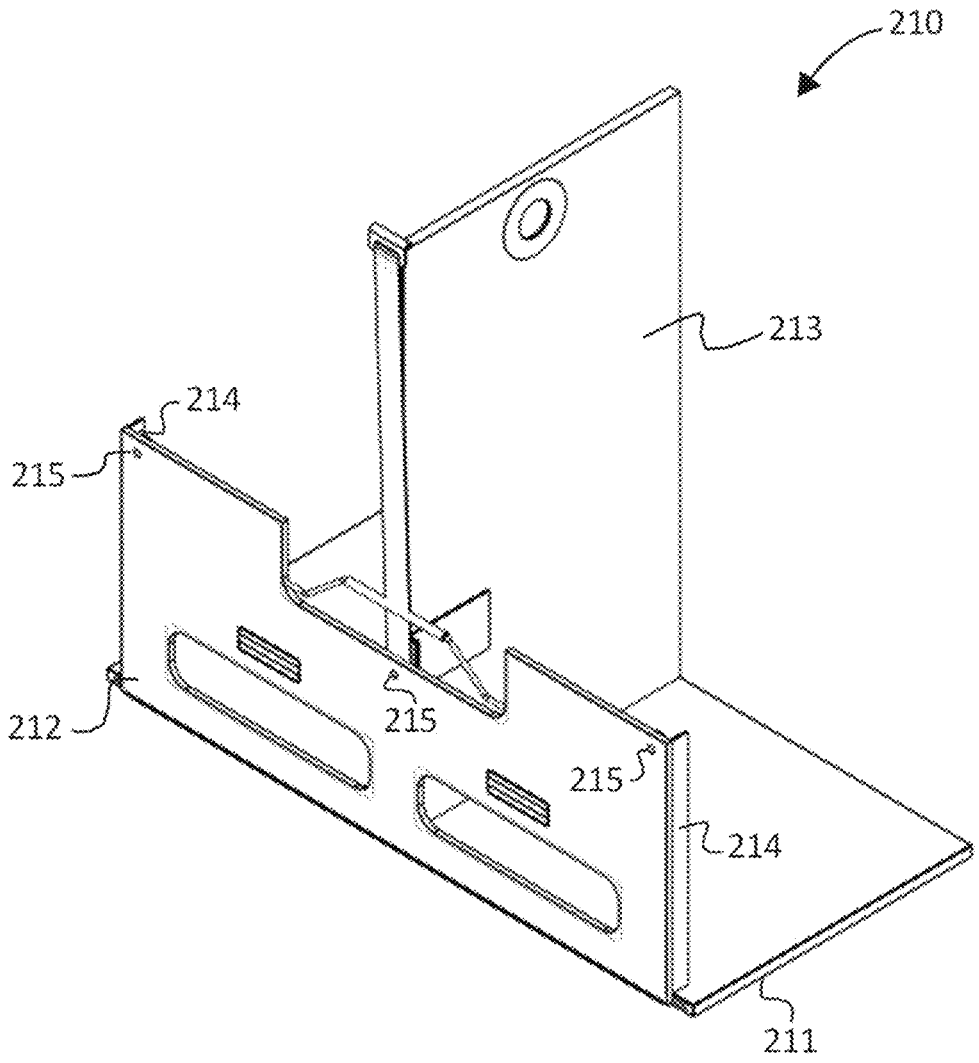
FIG. 4 illustrates a hanger bin for deploying in the inventory holder of FIG. 2 or FIG. 3.

Referring to FIGS. 2, 3, and 4, the hanger bin 210 can include a base or shelf 211, a door 212, and a divider 213. The door 212 can be pivotably coupled to the shelf 211. Additionally or alternatively, the door 212 may be coupled to a collapsible connector 214 to limit an opening of the bin. For example, the collapsible connector 214 can be accordion type, a band, or other connector configured to keep the door 212 partially open or preventing the door from pivoting downward past a predetermined threshold amount. Such partial opening (see FIG. 3) may ensure that the door 212, when open, falls within an interference zone Z1 associated with the inventory holder 200. The interference zone can be characterized by a clearance amount (e.g., Z1) or a clearance plane offset by an amount (e.g., Z1) from the inventory holder 200. This interference zone Z1 may ensure that while moving the inventory holder 200 using the mobile drive unit 250, no portion of the inventory holder 200 will bump into other objects or inventory holders within a storage area. For example, the inventory holder 100 may include an interference detection system (not illustrated) configured to generate an interruption signal, based on which the mobile drive unit 250 may be activated or deactivated. For example, a curtain of light may be passed from a top to a bottom of the inventory holder. If the curtain of light is interrupted due to presence of an object (e.g., an open door), the interference detection system can send a signal to stop or deactivate the mobile drive unit 250. As an example, the interference zone can be few centimeters or inches (e.g., 3 to 5 centimeters, or 1-2 inches) away from the front opening 102 of the fabric sleeve 100. Partial opening additionally or alternatively may facilitate retaining contents behind the door 212 in use, e.g., preventing items from falling out inadvertently when the door 212 is in an open state yet permitting sufficient space for an operator to reach in to extract an item in use.

The hanger bin 210 can be configured to couple with a set of mounts (e.g., 110 or 130) of a compartment (e.g., 111) of the fabric bin 100. In the illustrated embodiments, the hanger bin 210 can be coupled to the mounts 130 using the hanger rod 218. For example, the divider 213 can include a grommet 213*a* through which the hanger rod 218 can be passed. The divider 213 can be fixedly coupled to the base 211. In an example, a bottom edge of the divider 213 can be stitched to the base 211. In another example, a vertically extending strap may be coupled to the base 211 and a top end of the divider 213. Other techniques for attaching the divider 213 may be utilized. Thus, the hanger rod 218 when passed through the grommet 213*a* of the divider 213 and coupled to the mount 130 can releasably hold the hanger bin 210 within the compartment 111 of the fabric bin 100. For example, the hanger bin 210 may be supported relative to the sleeve 100 by the hanger rod 218 engaging the mounts 130 and/or may be supported by the shelf 211 engaging with the mounts 110.

The door 212 of the hanger bin 210 can further include a door retainer 215 configured to engage with the engagement tab 120A or other anchoring element on the fabric sleeve 100. As an example, the door retainer 215 (see FIG. 3) can be a magnet and retainer 213*a* of the engagement tab 120A can include a magnetic coupler (e.g., steel) to engage with the magnet when the door 212 is closed. The relative orientation can additionally or alternatively be reversed (e.g., such that metal is in the door retainer 215 and a magnet in the retainer 121*a* of the engagement tab 120A). Due to engagement between the door retainer 215 and the retainer ### of the engagement tab 120A, the door 212 can be closed and secured in place with respect to the fabric bin 100. This way, the door 212 in a closed state will stay close to the fabric bin 100 and not extend beyond the interference zone Z1. Hence, when the door 212 is closed, the inventory holder 200 can be moved around by the mobile drive unit 250 without a risk of collision with other inventory holders.

Figure 5:
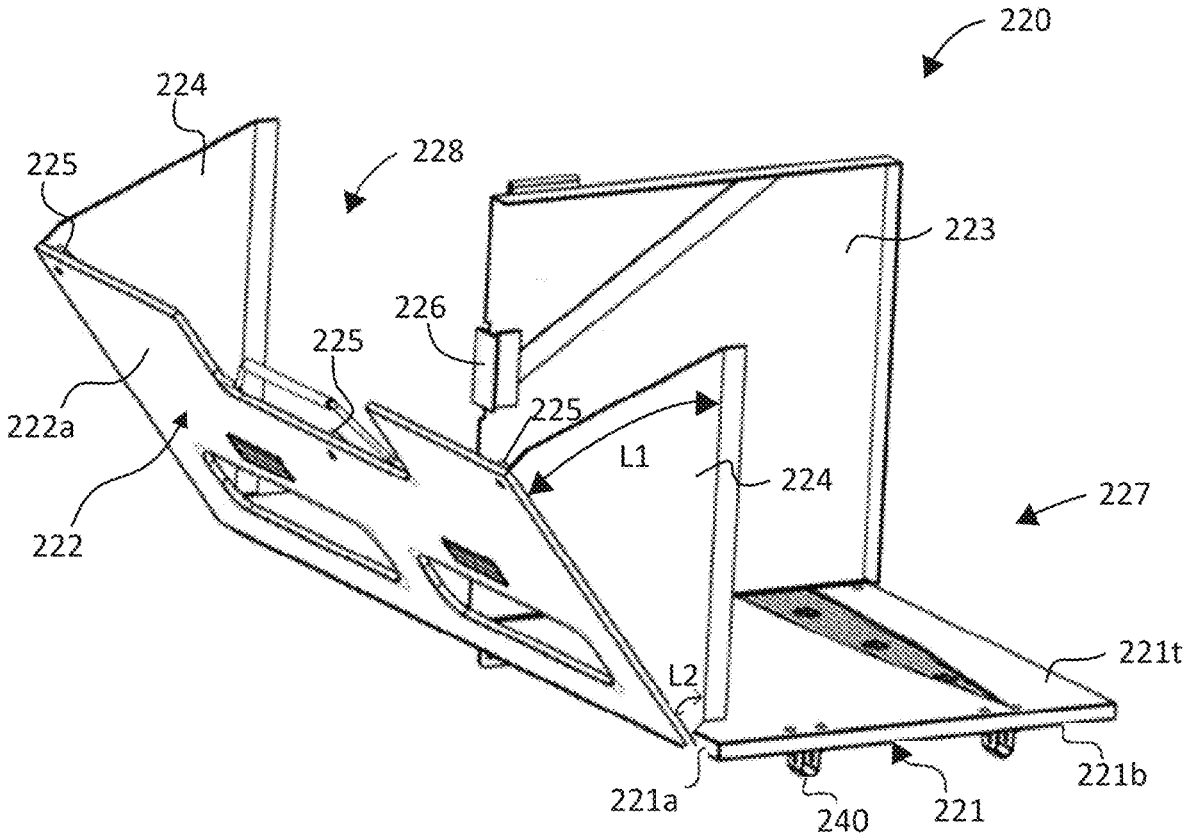
FIG. 5 illustrates a simple bin for deploying in the inventory holder of FIG. 2 or FIG. 3.

Referring to FIGS. 2, 3, and 5, the simple bin 220 can include a base 221, and a tiltable door 222. The tiltable door 222 can include a panel 222*a* and collapsible connectors 224. In some embodiments, the collapsible connectors 224 can be coupled to a compartment (e.g., 142 in FIG. 1) of the fabric sleeve 100 (see FIG. 3). For example, interfacing edges of the connectors 224 and the compartment (e.g., 142) may be stitched or glued together or coupled using hook and loop fasteners.

The panel 222*a* can include a releasable fastener 225 disposed along at least one side portion (e.g., left, right) of the panel 222*a* (see FIG. 5). For example, the releasable fasteners 225 are disposed on the left and right sides and attached to an inner side (facing towards the first portion 121 of the engagement tab 120A) or fixed inside the panel 222*a*. A bottom edge of the panel 222*a* can be pivotably coupled along a front edge 221*a* of the base 221. The panel 222*a* can extend upward from the base 221.

The collapsible connectors 224 can be attached to and extend at least partially along the opposite side portions (e.g., a left portion and a right portion in FIG. 5) of the panel 222*a* toward the base 221. The collapsible connector 224 can have an arcuate length L1 (see FIG. 5) at a top end and a smaller length L2 at a bottom end (see FIG. 5) when the collapsible connector 224 is fully extended. The lengths L1 and L2 can be selected to limit an amount of tilt of the tiltable door 222 to a specified degree (e.g., to prevent extension of the door 222 beyond the interference zone and/or to facilitate retention of items within behind the door 222 when the door is open). The collapsible connectors 224 can be an accordion connector, a band, or other flexible or collapsible connector element.

The tiltable door 222 can be in an open state or a closed state. In an open state (see FIGS. 3 and 5), the panel 222*a* can partially tilt with respect to the base 221 while the collapsible connectors 224 limit tilting of the panel to a specified degree. In a closed state, the panel 222*a* can stay closed by engaging the releasable fastener 225 with the first portion 121 of the engagement tabs 120A (see FIG. 3 call out) while the collapsible connectors 224 are collapsed.

The base 221 may be alternatively referred as a shelf and configured to include shelf brackets 240 couplable to a subset of mounts 110 (e.g., a set of coplanar mounts 142 in FIG. 1). As illustrated in FIGS. 2 and 5, the shelf brackets 240 can be provided at a bottom surface 221*b* of the simple bin 220. The shelf brackets 240 can extend into and couple with a set of mounts 110 (e.g., the coplanar mounts 142) of a compartment (e.g., 112) of the fabric sleeve 100.

In some embodiments, the simple bin 220 can further include a divider 223 couplable to the base 221. For example, the divider 223 can be removably attached to a top surface 221*t* of the base 221 to divide a space above the top surface 221*t* into a first storage portion 227 and a second storage portion 228. The divider 223 may further include a retainer 226 (see FIG. 5) configured to couple with the releasable faster 225 (e.g., disposed at a center portion of the top edge in FIG. 5). The retainer 226 may be utilized with to supplement or replace engagement along lateral edges of the panel 222, for example.

In many embodiments, the tiltable door 222 including the collapsible connectors 224 can be structurally and functionally similar to the door 212 of the hanger bin 210 including the collapsible connectors 214. Hence, for brevity, discussion with respect to the door 212 may be applicable to the tiltable door 222 or vice versa.

As can be seen from the illustrated examples of bin structures, the simple bin 220 can be used to store and retrieve items such as shoes, rolled clothing, boxes, etc. Similar contents may be contained behind the door 212 in the hanger bin 210 in some instances. Additionally or alternatively, the hanger bin 210 can be used to store items to be hanged on a rod 218 such as jackets, shirts, or other large items that may be not conducive to hang on the hanger rod or non-conducive to be stored in the simple bin 220. The hanger bin 210 can be larger than the other bins 220, 230. For example, the height of the hanger bin 210 can be twice a height of the simple bin 220, and/or three or four times the height of the drawer bin 230. So, for example, the hanger bin 210 can be replaced with two simple bins 220 when the hanger bin 210 is no longer efficient to store items per changed trends or seasons. Such interchangeability or reconfiguration can be achieved by the interchangeability and interlocking between each of the mounts 110 and corresponding shelf brackets on the bins.

Figure 6:
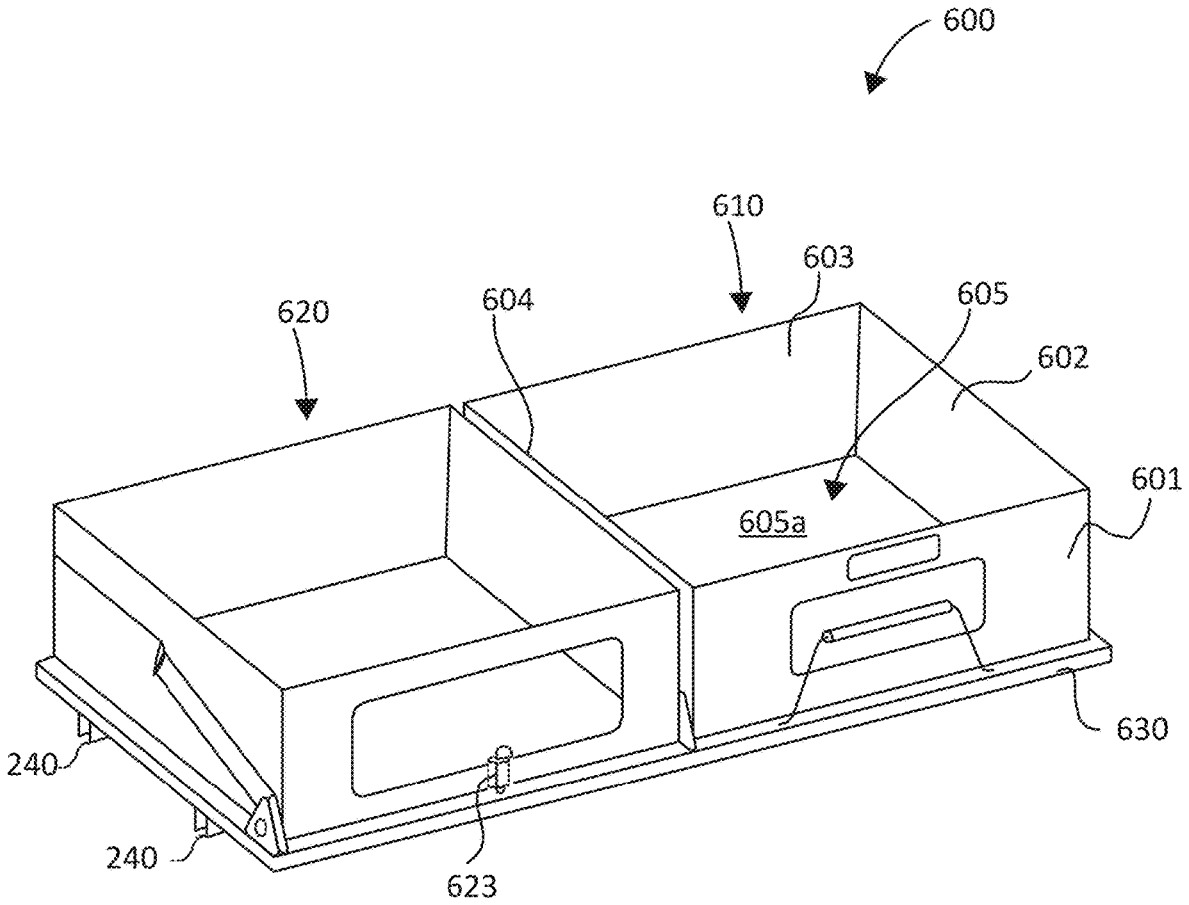
FIG. 6 illustrates a drawer bin assembly for deploying in the inventory holder of FIG. 2 or FIG. 3.
Figure 7:
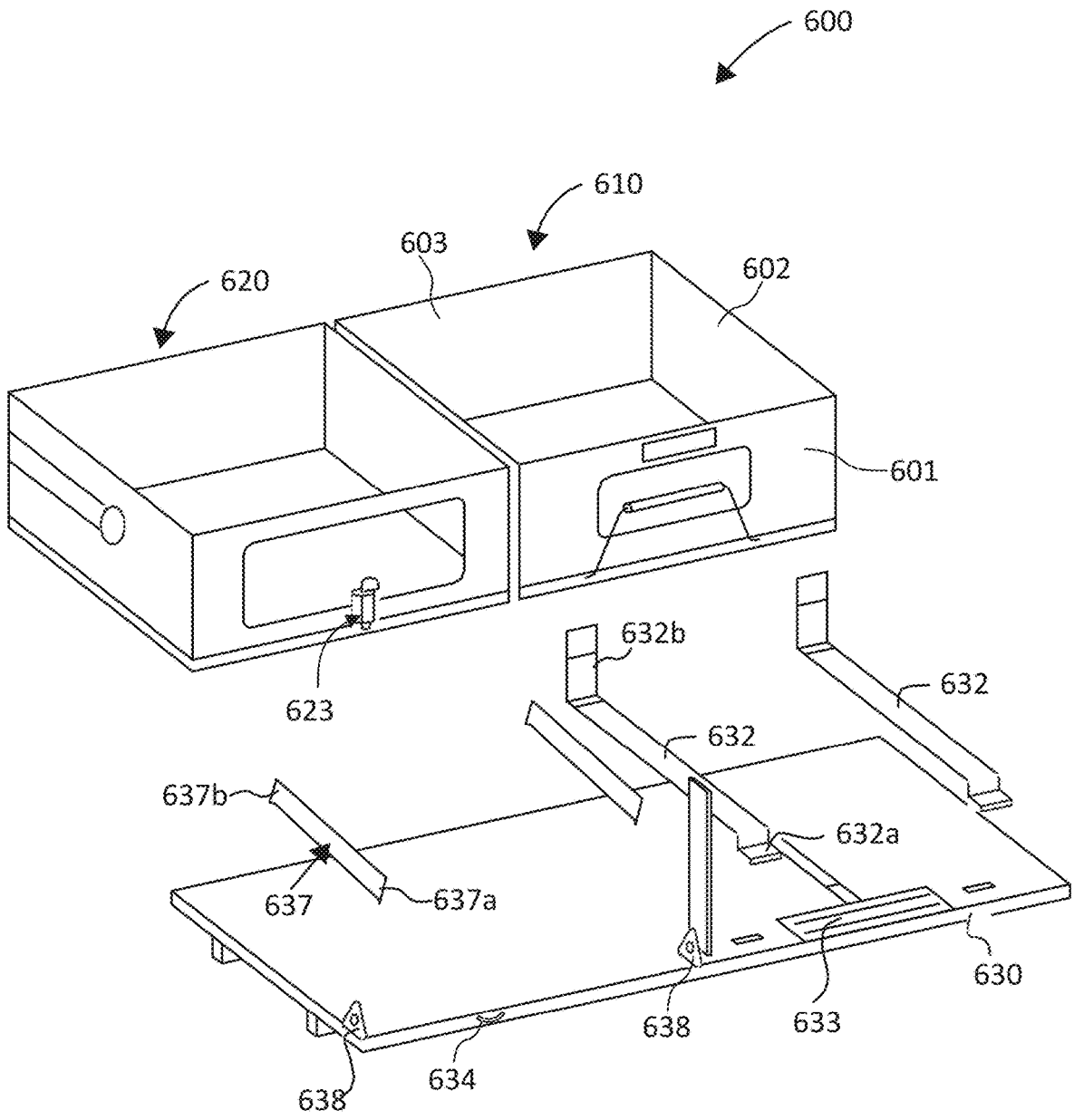
FIG. 7 illustrates an exploded view of the drawer bin assembly of FIG. 6 in accordance with various embodiments.
Figure 8:
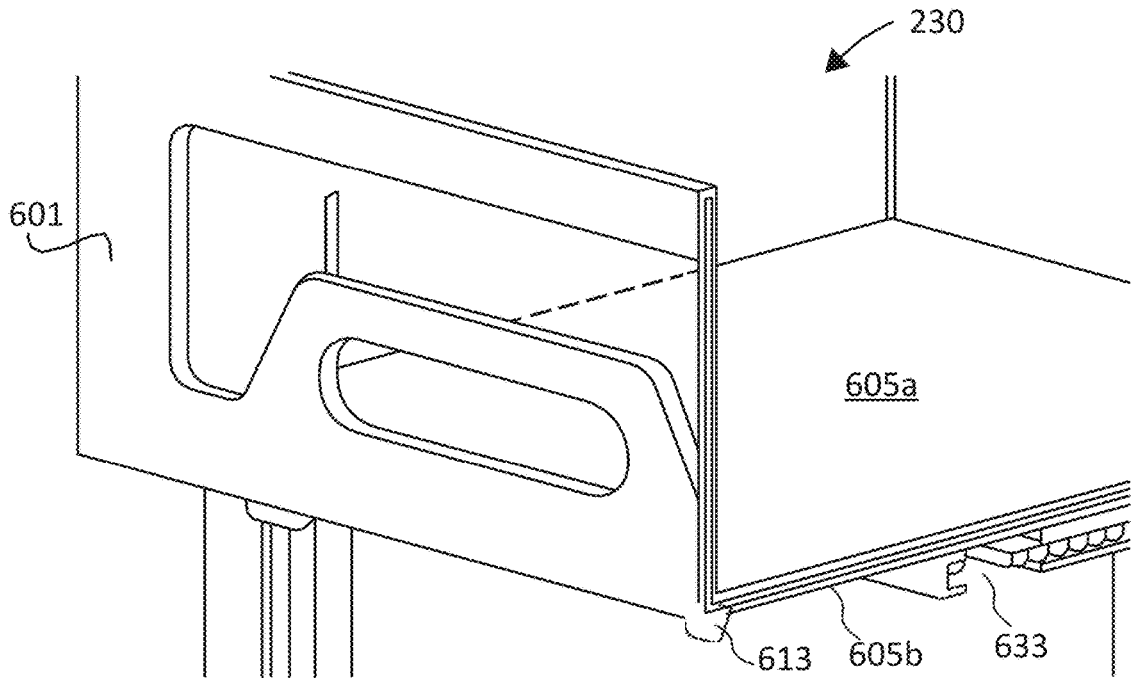
FIG. 8 illustrates a drawer bin of FIG. 6 in an open state or an unlocked state.
Figure 9:
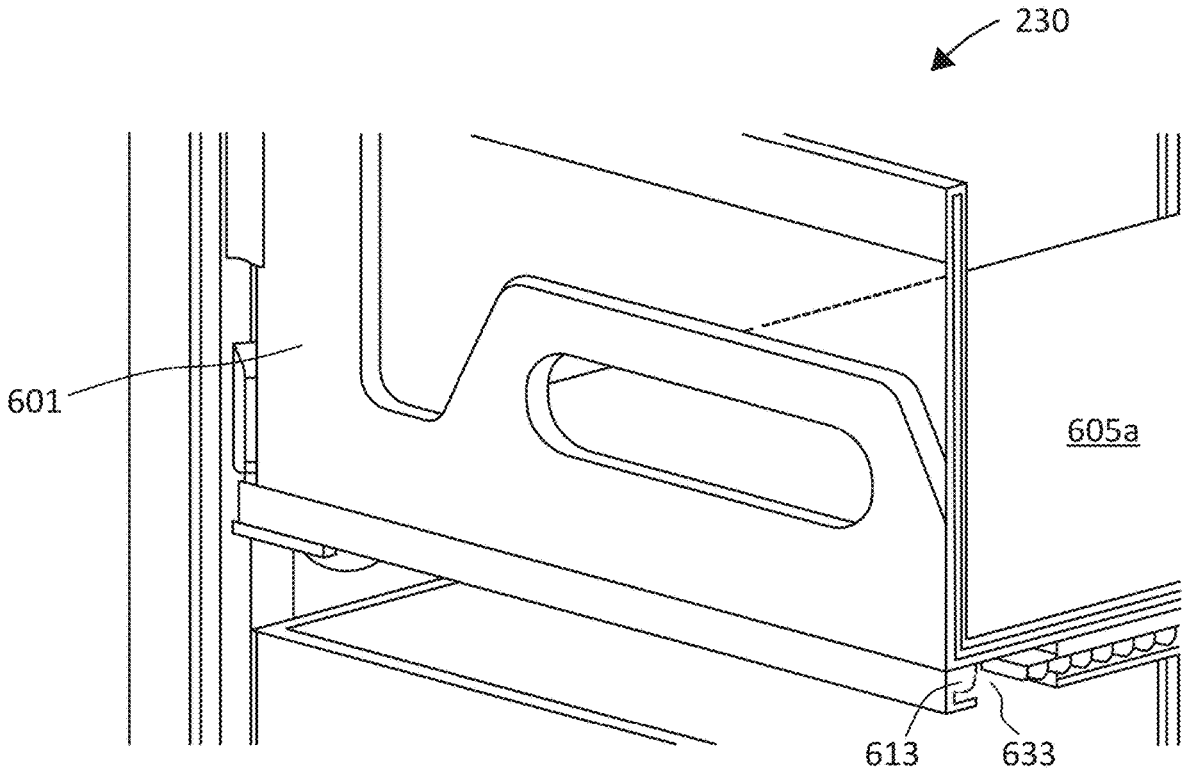
FIG. 9 illustrates the drawer bin of FIG. 6 in a closed state or a locked state.

FIG. 6 through FIG. 9 illustrate a drawer bin assembly 600 for deploying in an inventory holder. FIG. 6 and FIG. 7 illustrate an assembled view and an exploded view, respectively, of the drawer bin assembly 600. FIG. 8 and FIG. 9 illustrate an open state (or unlocked state) and a closed state (or locked state), respectively, of a drawer bin of the drawer bin assembly 600. As an example, the drawer bin assembly 600 can be configured to be received within a fabric sleeve 100 of the inventory holder 200 (in FIG. 2 or FIG. 3). However, the present disclosure is not limited to such configuration. The drawer bin assembly 600 can be configured to deploy in other inventory holders and/or in other contexts that may or may not have the fabric sleeve 100.

The drawer bin assembly 600 includes one or more drawer bins (e.g., 610, 620) disposed over a shelf (e.g., 630), and one or more biasers (e.g., 632, 637) to bias each of the drawer bins (e.g., 610, 620) with respect to the shelf 630. In the illustrated embodiments, the drawer bin 610 can includes a locking element such as a locking projection 613 (see FIG. 8). As another example, the drawer bin 620 can include a different locking element 623 (see FIGS. 6, 7). The drawer bins 610, 620 may also include a handle (not labelled). In the illustrated embodiment, two drawer bins can be disposed adjacent to each other. The two drawer bins can be same or different relative to one another. In the illustrated example, the drawer bin 610 can be disposed adjacent to another drawer bin 620 different from the drawer bin 610. The drawer bins can differ based on biaser coupling and/or a locking element, but an open box-like structure of each bin can be same. However, in other examples, both the drawer bins can be the drawer bins 610 or the drawer bins 620 or a single drawer bin may be provided instead (e.g., extending substantially an entire width of the drawer bin assembly 600).

The drawer bins 610, 620 can be configured to operate single-handedly between an open-state (unlocked state) and a closed state (locked state). For example, an operator can single-handedly unlock a drawer bin (e.g., 610, 620) by using one hand to accomplish disengaging the locking element from the shelf 630. With the locking element disengaged, the biaser can automatically push out the respective bin. To close, the operator can simply push on a handle of the drawer bin (e.g., 610, 620) until the locking element engages with a corresponding locking feature of the shelf 630 or is suitably positioned to be moved into locking position by the same hand that is or was pushing the drawer bin.

The drawer bin 610 (or 620) includes at least two walls (e.g., a front and back) or four side walls 601-604 (e.g., a front, back, left, and right side walls) extending form a base 605. As shown more clearly in FIG. 8, the base 605 has a top surface 605*a* and a bottom surface 605*b* The locking projection 613 may be disposed at, on, and/or along the bottom surface 605*b*. In the illustrated embodiment, in FIG. 8, the locking projection 613 of the drawer bin 610 can be an angled plate projecting from the bottom surface 605*b* of the drawer bin 610 (e.g., angling downwardly and away from a rear of the drawer bin 610). In another example, as shown in FIG. 6 and FIG. 7, a locking element of the drawer bin 620 can be a latch 623 disposed on a front wall (e.g., like 601 of the bin 610) of the drawer bin 620. The latch 623 may include a manually operated plunger or a spring loaded plunger. The latch 623 can be configured to engage with a corresponding locking feature 634 at a front portion of the shelf 630. For example, the locking feature 634 may be a ring, a slot, or a U-shaped bracket configured to receive a plunger of the latch 623.

Figure 10:
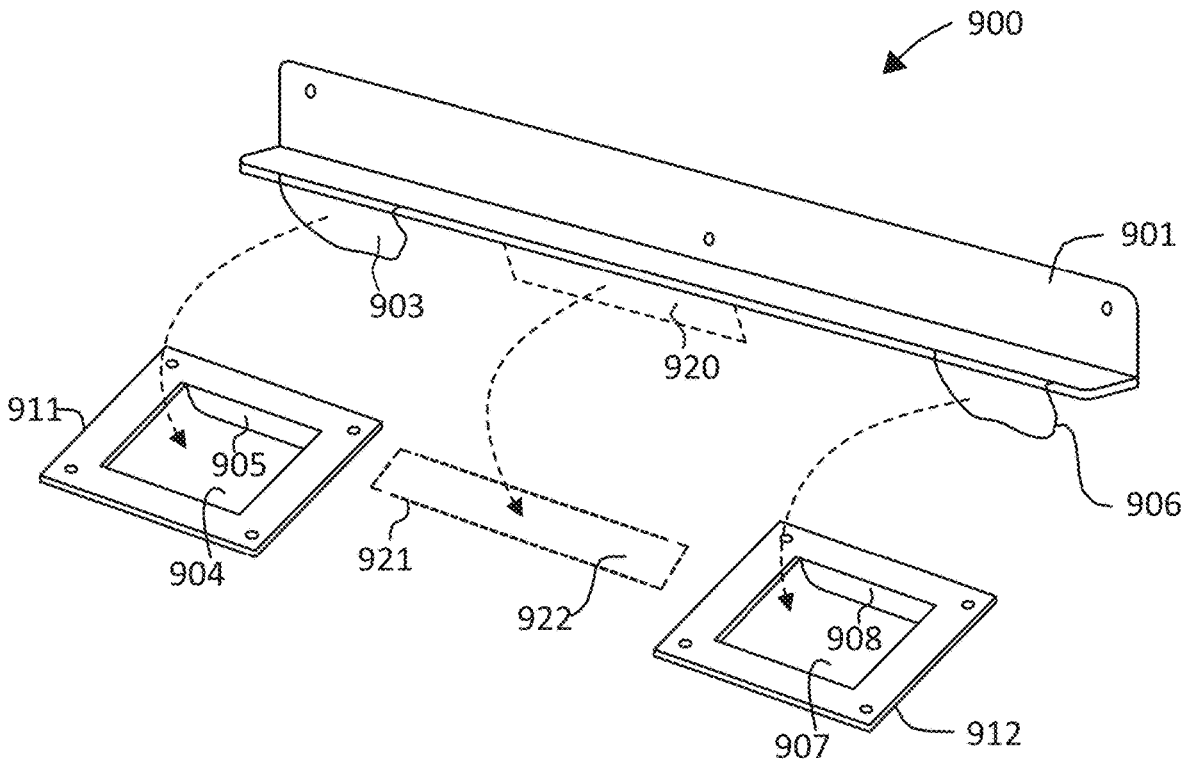
FIG. 10 illustrates a lock subassembly couplable to the drawer bin of FIG. 6.

FIG. 10 illustrates a locking projection 900 couplable to a front edge of the drawer bin 610. The locking projection 900 may include a lock bracket 901 having one or more angled plates. For example, the lock bracket 901 can be an elongate plate fixedly attachable to a bottom surface of the drawer bin 610. In one example, the lock bracket 901 includes angled plates 903 and 906 spaced from each other. Corresponding lock plates 911 and 912 including lock openings 904 and 907 (an example of 633 in FIG. 7), respectively, may be fixedly attached to a shelf to receive respective angled plates 903 and 906. In another example, the lock bracket 901 may include a single angled bracket 920 disposed along a center portion. A corresponding lock plate 921 with a lock opening 922 may be attached to the shelf to receive the angled plate 920. It can be understood that the present disclosure is not limited to angled plates and other shapes or types of locking elements may be utilized.

Referring back to FIGS. 6-8, the shelf 630 can include a corresponding locking element to engage with the locking element of the drawer bin. For example, the shelf 630 can include a lock opening 633 (seen in FIG. 7 and FIG. 8). The lock opening 633 may be configured to engage with the locking projection 613 of the drawer bin 610 and secure the drawer bin 610 to the shelf 630. As illustrated in FIG. 8, the lock opening 633 of the shelf 630 may include a complimentary angled element (like a projection 905 of FIG. 10) engageable with the angled plate 613 of the drawer bin 610. For example, as best seen in FIG. 9, an angled portion of the locking projection 613 may engage a mating angled portion of the lock opening 633 to retain components in a closed state. To move from the closed state in FIG. 9 toward the open state in FIG. 8, an operator may push inward and slightly upward (e.g., which may disengaging the angled surfaces of the locking projection 613 and the lock opening 633 so that the drawer can be pulled or biased open). To move from the open state in FIG. 8 toward the closed state in FIG. 9, the operator may push inward until the locking projection 613 and the lock opening 633 align (e.g., from an effect of gravity drawing the angled surface the locking projection 613 downward into the lock opening 633 and/or from the operator imparting a downward motion upon suitable alignment).

The shelf 630 can have a planar rectangular shape. In many embodiments, the shelf 630 can include one or more shelf brackets 240 (see FIG. 6) for mounting with an inventory holder. For example, the shelf 630 may include shelf brackets 240 configured to align with and releasably couple with a subset of mounts 110 e.g., when installing in the inventory holder 200 (in FIG. 2).

The biaser 632 can be coupled to the drawer bin 610 and the shelf 630 such that the drawer bin 610 can be biased to extend more than halfway out or fully extend with respect to the shelf 230 when the drawer bin 610 is unlocked from the shelf 630. In some embodiments, the biaser 632 includes a first end portion 632*a* and a second end portion 632*b*. The first end portion 632*a* can be coupled to a front portion of the shelf 630 and the second end 632*b* can be coupled to a back portion (e.g., back of the back wall 603) of the drawer bin 610. When the drawer bin 610 is locked with the shelf 630, the biaser 632 can be in tension. When unlocked from the shelf 630, the biaser 632 pushes out the drawer bin 610 to extend out with respect to the shelf 630. In another example, a biaser 637 (similar to the biaser 632) can be coupled to sides of the drawer bin 620. As illustrated in FIG. 6 and FIG. 7, a first end portion 637*a* of the biaser 637 may be coupled to a biaser retainer 638 at the front portion of the shelf 630 and the second end portion 637*b* may be coupled to a side wall 602, 604 of the drawer bin 620. In many embodiments, the biaser 632 can be an elastic strap, a spring loaded strap, or other biasing element.

In some embodiments, the drawer bin assembly 600 can be used as the drawer bin 230 to be disposed in the fabric sleeve 100, as show in FIG. 2 and FIG. 3. For example, the shelf 630 can include the brackets 240 to releasably mount the shelf 630 within a compartment (e.g., 115) of the fabric bin 100. Once coupled to the mounts 110, the shelf 630 is fixed and does not move relative to the fabric bin 100. The drawers 610 can be sized to slidably fit in a compartment of a fabric sleeve 100.

Figure 11:
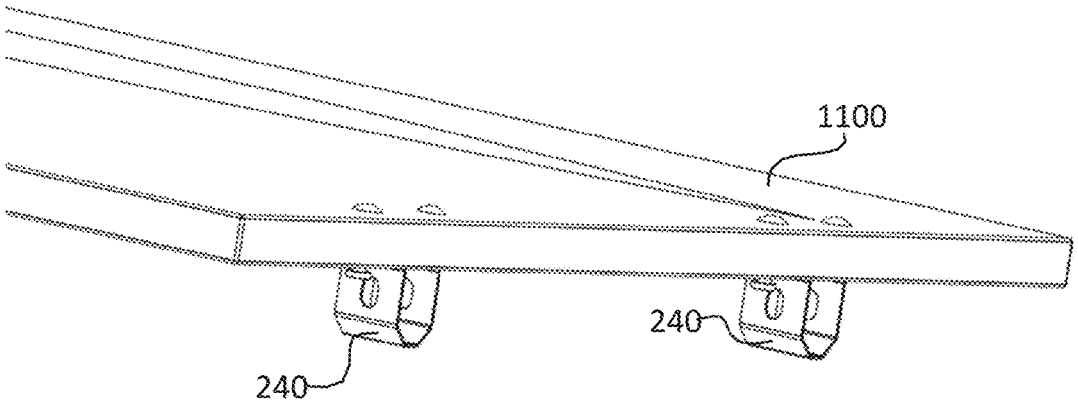
FIG. 11 illustrates a shelf portion with shelf brackets in accordance with various embodiments.

FIG. 11 illustrates a portion of a shelf 1100 with shelf brackets 240. The shelf 1100 can be bottom part of the bins (e.g., 210, 220, 230 in FIG. 2) or other bins. The shelf 1100 with the shelf brackets 240 can serve as an interchangeable structure that facilitates swapping of bins within the fabric sleeve 100 (e.g., see FIG. 2). The shelf 1100 can be a separate component (e.g., in case of the drawer bin 230) or integrated as a base of the bin (e.g., a simple bin 220).

Figure 12:
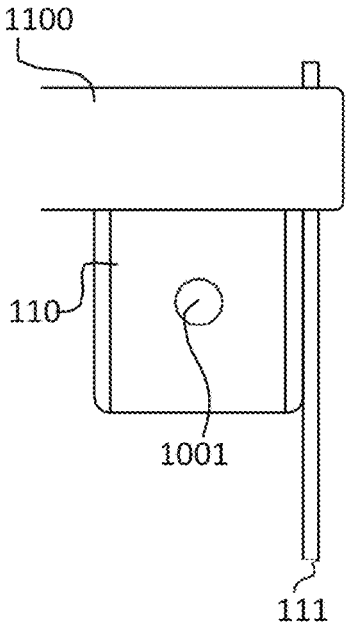
FIG. 12 and FIG. 13 illustrate a front view and a side view of the shelf bracket of FIG. 11 coupled with a mount of the fabric sleeve of FIG. 1.
Figure 13:
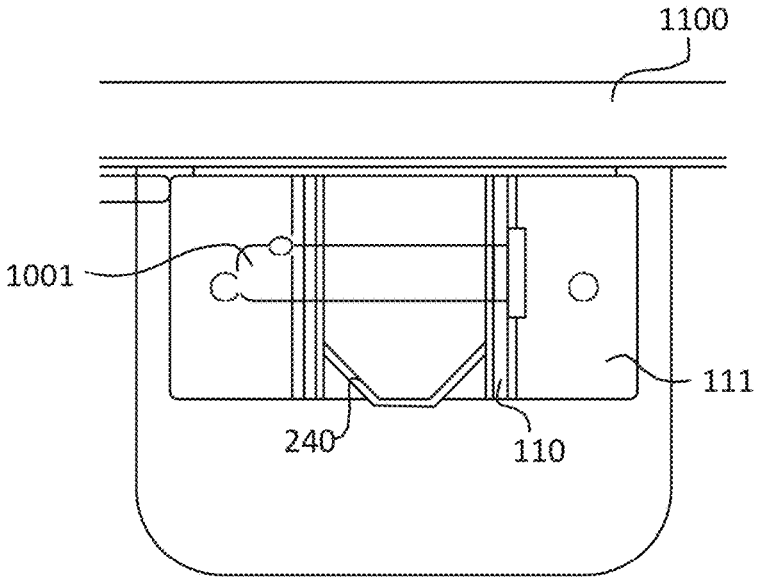

FIG. 12 and FIG. 13 illustrate a front view and a side view of the shelf bracket 240 coupled with a mount 110 of the fabric sleeve 100 (e.g., of FIG. 1). As an example, the shelf bracket 240 can be inserted in the mount 110 (see FIG. 13) such that holes of the bracket 240 align with the holes of the mount 110. Once aligned, a pin 1001 can be passed through the mount 110 and the bracket 240 to releasably couple the shelf 1100 to the mount 110. When swapping the bins having the shelf 1100, the pin 1001 can be removed to disengage the shelf 1100 and remove the bin (e.g., a simple bin 220) from a compartment of the fabric sleeve 100. Then, one or more another bins (e.g., a drawer bin 230) can be inserted within the empty compartment. The brackets 240 of the one or more bins can be aligned with the subset of mounts 110 of the empty compartment to releasably couple the shelf 1100. This way different inventory holder configurations can be created to optimize use of the storage space of the inventory holder.

FIG. 14 illustrates views (A)-(H) of different configurations of inventory holders achieved using the fabric sleeve 100 and interchangeable structures (e.g., shelves with shelf brackets couplable with mounts of the fabric sleeve) associated with the bins. For example, a inventory holder can be configured to include one or more hanger bins 210, one or more simple bins 220, one or more drawer bins 230, or a combination thereof. In view (A), the inventory holder 1410 is arranged to include one hanger bin 210, one simple bin 220, and six drawer bin assemblies 230 (each including two drawer bins). The hanger bin 210 may be disposed in a first compartment at an upper side of the inventory holder, the simple bin 220 can be disposed in a second compartment below the hanger bin 210, and the drawer bin assemblies 230 can be disposed in remaining compartments below the simple bin.

In another example configuration, in view (B), the inventory holder 1420 is arranged to include two hanger bins 210, and four drawer bin assemblies 230 (each including two drawer bins). In another example configuration, in view (C), an inventory holder 1430 can include only simple bins 220. In another example configuration, in view (D), an inventory holder 1440 can include one hanger bin 210, two simple bins 220, and four drawer bin assemblies 230 (each including two drawer bins). In another example configuration, in view (E), an inventory holder 1450 can include one hanger bins 210, three simple bins 220, and two drawer bin assemblies 230 (each including two drawer bins). In another example configuration, in view (F), an inventory holder 1460 can include two hanger bins 210, one simple bin 220, and two drawer bin assemblies 230 (each including two drawer bins). In another example configuration, in view (G), an inventory holder 1470 can include one hanger bin 210, and four simple bins 220. In another example configuration, in view (H), an inventory holder 1480 can include two hanger bins 210, and two simple bins 220. As can be seen from these configurations, depending on sizes of items (e.g., large storable in a hanger bin, medium storable in a simple bin, or small storable in a drawer bin) the inventory holder can be configured appropriately to optimize the storage space.

Figure 15:
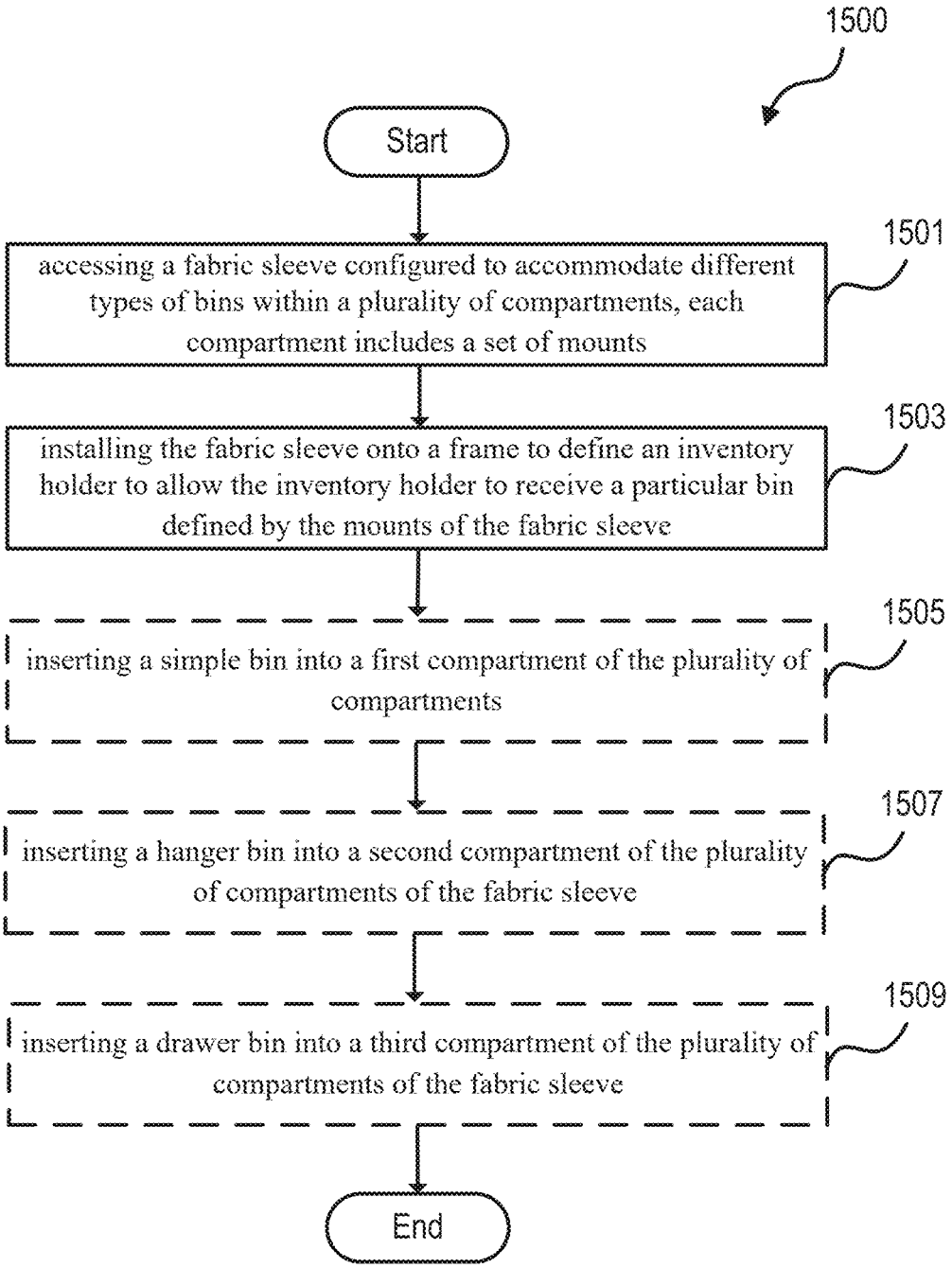
FIG. 15 is a flow chart illustrating a process of assembling an inventory holder in accordance with various embodiments.

FIG. 15 is a flow chart of a method 1500 of assembling an inventory holder assembly. The method 1500 can involve acts of receiving a fabric sleeve and installing the fabric sleeve on a frame structure (e.g., discussed with respect to FIG. 2). Further depending on storage demands, one or more bins may be installed in the fabric sleeve. Example acts involved in the method 1500 are further discussed below with reference to FIGS. 2-5 as example implementations without limiting the method to such example embodiments or structures.

Act 1501 can involve accessing a fabric sleeve configured to accommodate different types of bins. The fabric sleeve can include a plurality of compartments. Each compartment can include a set of mounts couplable to interchangeable bin structures defining which bin is receivable within each compartment thereby facilitating customizable the fabric sleeve. For example, as discussed with respect to FIG. 1 and FIG. 2, the fabric sleeve 100 can include a plurality of compartments 111-116, and each compartment can include a set of mounts 110 and/or 113. These mounts can be coupled with interchangeable structures such as shelf brackets (e.g., 240) on the bins (e.g., 220, 230).

Act 1503 can involve installing the fabric sleeve onto a frame to define an inventory holder to allow the inventory holder to receive a particular bin defined by the mounts of the fabric sleeve. For example, as illustrated in FIG. 2, the fabric sleeve 100 can be installed on the frame elements 201. For example, the frame elements 201 can be separate components insertable via pockets or straps at corners of the fabric sleeve 100. Further, the bottom wall 106 of the fabric sleeve 100 can be coupled to the base frame 203.

In some embodiments, the method 1500 can further involve act 1505 involving inserting a simple bin into a first compartment of the plurality of compartments. The interchangeable bin structures can include shelf brackets disposed at a bottom side of the simple bin and configured to couple with a first set of mounts of the first compartment. For example, as shown in FIGS. 2, 3 and 5, the simple bin 220 can include the base 221 with brackets 240 couplable with a set of coplanar mounts 110. Accordingly, in an example, the inserting of the simple bin can include aligning the shelf brackets (e.g., 240) of the simple bin (e.g., 220) with the first set of mounts (e.g., 110 within coplanar mounts 142) of the first compartment (e.g., 112). The first compartment (e.g., 112) can further include retractable engagement tabs (e.g., 120A). The simple bin (e.g., 220) can include a tiltable door (e.g., 222). The inserting of the simple bin can further include assembling the simple bin (e.g., 220) into the first compartment (e.g., 112) of the fabric sleeve (e.g., 100) such that the tiltable door (e.g., 222) is engageable or disengageable from the retractable engagement tabs (e.g., 120A) of the first compartment.

In some embodiments, inserting the simple bin can further include adjusting a retractable engagement tab (e.g., 120A) of the first compartment to facilitate engagement of a door of the simple bin when closed. The retractable engagement tab (e.g., 120A) can include a first portion (e.g., 121 in FIG. 1) configured to engage with a tiltable door (e.g., see 222 in FIG. 3) of the simple bin (e.g., 220) and a second portion (e.g., 122 in FIG. 1) configured to provide structural support to the first portion (e.g., 121). The first portion (e.g., 121) can be alignable with the second portion (e.g., see 120B FIG. 1 where 121 is aligned with 122) or orientable at an angle with the second portion (e.g., see 120A FIG. 1 where 121 is angled with 122). Accordingly, in some embodiments, adjusting the retractable engagement tab (e.g., 120A) can include orienting the first portion (e.g., 121) of the retractable engagement tab (e.g., 120A) in a vertical plane. The first portion (e.g., 120A) can include a magnetic coupler couplable with a magnet of the tiltable door (e.g., 222) of the simple bin (e.g., 220). Additionally or alternatively, the second portion (e.g., 122) can be oriented at an angle with the first portion (e.g., 121) to provide structural support to the oriented first portion (e.g., 121). For example, the second portion (e.g., 122) can includes a rigid panel.

In some embodiments, the method 1500 can further involve act 1507, which involves inserting a hanger bin into a second compartment of the plurality of compartments of the fabric sleeve. The interchangeable bin structures can include a divider with grommet (e.g., see 213 in FIG. 2) configured to receive a hanger rod (e.g., 218). In another example, shelf brackets may be disposed at a bottom side of the simple bin and configured to couple with the second set of mounts of the second compartment. The hanger bin (e.g., 210) can be larger than the simple bin (e.g., 220). For example, a height of the hanger bin can be twice the size of a simple bin, while the width and depth may be same.

In some embodiments, the method 1500 can further involve act 1509 involving inserting a drawer bin (e.g., 230) into a third compartment of the plurality of compartments of the fabric sleeve (e.g., 100). The drawer bin (e.g., 230) can be smaller than the simple bin (e.g., 220). As an example, inserting the drawer can include coupling a shelf (e.g., 221 in FIG. 2) to a third set of mounts (e.g., see coplanar mounts 143 in FIG. 1) of the third compartment. The shelf can include shelf brackets (e.g., 230) couplable to the third set of mounts. Additionally or alternatively, inserting the drawer bin can involve stowing away retractable engagement tabs (e.g., 120B in FIGS. 1 and 2) of the third compartment to receive the drawer bin (e.g., 220).

Figure 16:
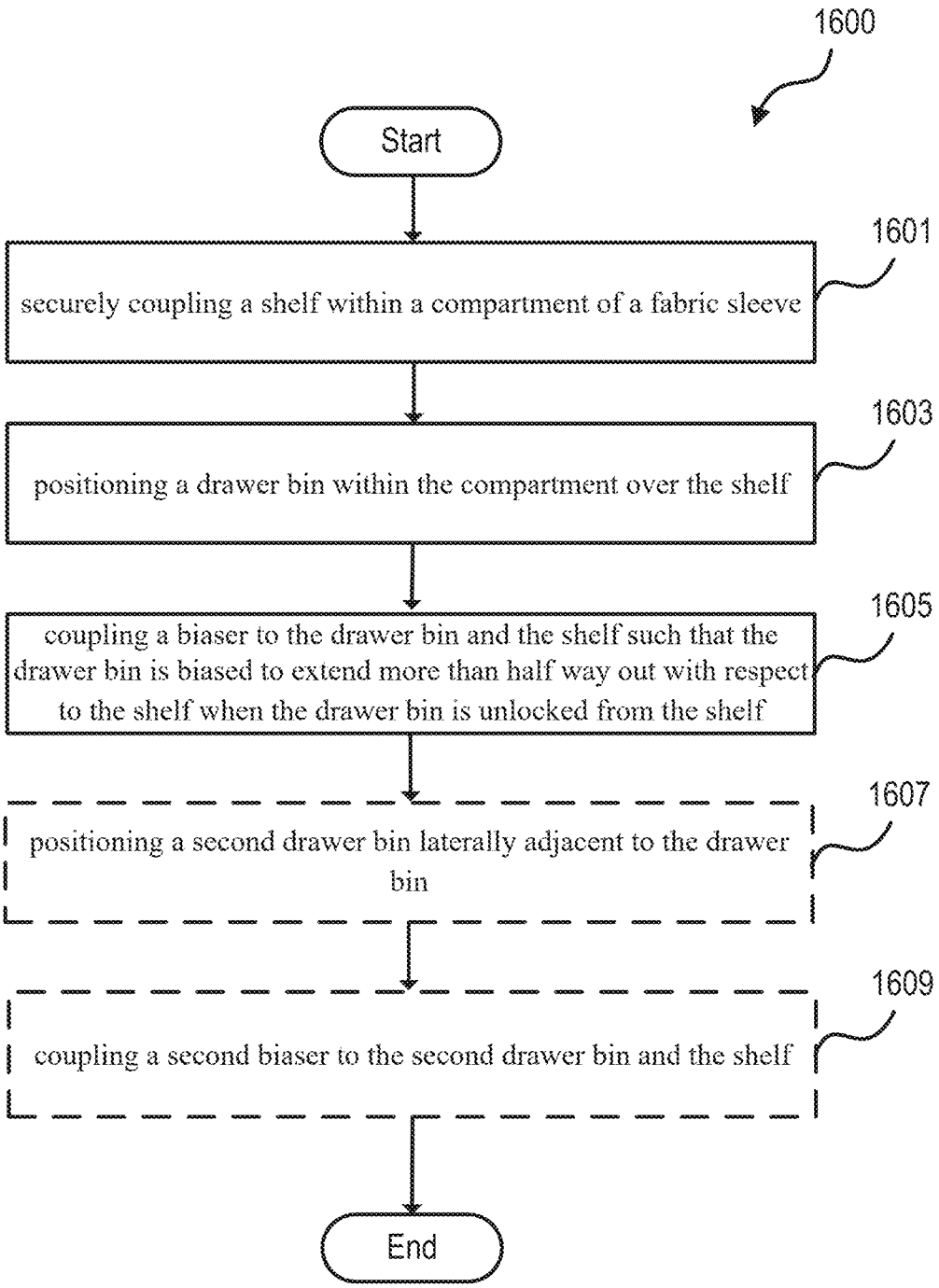
FIG. 16 is a flow chart illustrating a process of assembling an inventory holder in accordance with various embodiments.

FIG. 16 is a flow chart of another method 1600 of assembling an inventory holder. The method 1600 includes installing a drawer assembly within the inventory holder. Acts involved in the method 1600 are explained below with reference to FIGS. 2 and 6-9 as example implementations without limiting the method to such example embodiments or structures.

Act 1601 can involve releasably coupling a shelf within a compartment of a fabric sleeve. For example, referring to FIG. 2, a shelf 231 can be coupled to a set of mounts 110 within the compartment 115 of the fabric sleeve 100. In some embodiments, releasably coupling the shelf can include aligning shelf brackets located at a bottom of the shelf with a set of mounts of the compartment; and securing each of the shelf brackets to a corresponding mount of the set of mounts via a coupling pin. For example, as shown in FIGS. 11-13, the shelf 1100 (which can be an example of shelf 231) can include the shelf brackets 240. The shelf brackets 240 can be aligned with and coupled to the mounts 110 via the coupling pin 1001. This way, the shelf 231 can be releasably coupled within the compartment (e.g., 115 in FIG. 2) of the fabric sleeve 100 (e.g., in FIG. 2).

Act 1603 can involve positioning a drawer bin within the compartment over the shelf. The shelf 231 can include the lock opening (e.g., see 633 FIG. 7). The drawer bin can include a locking element (e.g., a locking projection) configured to couple with the lock opening of the shelf and lock the drawer bin to the shelf. For example, referring to FIGS. 2 and 7, the drawer bin 610 (which can be an example of the drawer bin 220 in FIG. 2) can be placed over the shelf 631 (an example of the shelf 231 in FIG. 2) which is releasably coupled within the compartment 115 of the fabric sleeve 100. The drawer bin 610 can include the locking projection 613 (e.g., best seen in FIG. 8) which can lock with the lock opening 633 of the shelf 631 (see FIGS. 8 and 9).

Act 1605 can involve coupling a biaser to the drawer bin and the shelf such that the drawer bin is biased to more than halfway extend out with respect to the shelf when the drawer bin is unlocked from the shelf. For example, the drawer bin can be biased to fully open or extend with respect to the shelf so that storage space within the drawer bin be readily accessed. As an example, coupling the biaser can involve coupling a first end of the biaser to a front portion of the shelf, and coupling a second end of the biaser to a back portion of the drawer bin. This way, when the drawer bin is locked with the shelf, the biaser can be in tension. When unlocked from the shelf, the biaser can push out the drawer bin to extend more than halfway or fully extend out from the compartment. For example, FIG. 7 illustrates an example of coupling of the biaser 632 with the drawer bin 610 and the shelf 630. The first end 632*a* of the biaser can be coupled to the front portion 634 of the shelf 630 and the second end 632*b* of the biaser 632 can be coupled to the back of the wall 602 of the drawer bin 610. FIG. 3 illustrates an open state of the drawer bin 220 (which can be examples of the drawer bin 610) when it is disposed within a compartment of the inventory holder.

It may be noted that act 1601 may be performed before or after other acts, e.g., such that the shelf 630 may be installed and then received structure for the drawers 610 or such that the drawers 610 may be coupled together with the shelf 630 into a collective assembly that may be collectively installed within the fabric sleeve 100.

Once the drawer bin is installed, the method 1600 may include single-handedly unlocking the drawer bin (e.g., 610 in FIG. 7) from the lock opening (e.g., 633 in FIG. 7) of the shelf (e.g., 630) to access items stored within the drawer bin (e.g., 610). Also, the drawer bin (e.g., 610) can be single-handedly moved against the biaser (e.g., 632) until the drawer bin (e.g., 610) is locked with the shelf (e.g., 630 in FIG. 8).

Additionally or alternatively, the method 1600 may further include act 1607 involving positioning a second drawer bin (e.g., another bin 610 or bin 620 in FIG. 7) laterally adjacent to the drawer bin (e.g., 610). The shelf (e.g., 630) can further include a second locking opening to engage with a locking feature (e.g., 613 or 623 in FIG. 6) of the second drawer bin (e.g., 610 or 620).

Furthermore, act 1607 can involve coupling a second biaser (e.g., 632 or 637) to the second drawer bin (e.g., 610 or 620) and the shelf (e.g., 630). The second biaser can be coupled in a similar manner as discussed in act 1603 or on side of the drawer (as illustrated in FIG. 6). For example, the second drawer bin (e.g., another instance of 610) can be biased to extend more than halfway out (e.g., see FIG. 3) with respect to the shelf (e.g., 231) when the second drawer bin (e.g., 610) is unlocked from the shelf (e.g., 231). In many embodiments, the drawer bin (e.g., 610) can be operated independently of the second drawer bin (e.g., another instance of the bin 610).

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A simple bin system including a simple bin comprising:

a base including a front edge; and a tiltable door comprising:

a panel including a releasable fastener disposed along at least one side portion of the panel; and a bottom edge pivotably coupled along the front edge of the base, wherein the panel extends upward from the base; and collapsible connectors attached to and extending at least partially along opposite side portions of the panel toward the base, wherein in an open state, the panel is configured to partially tilt with respect to the base while the collapsible connectors limit tilting of the panel to a specified degree, wherein each of the collapsible connectors is an accordion connector having an arcuate length configured to limit tilting of the panel to the specified degree, and wherein in a closed state, the panel is configured to stay closed via the releasable fastener while the collapsible connectors are collapsed.

2. The simple bin system of claim 1, further comprising a divider couplable to the base, wherein the base includes a top surface and the divider is removably attached to the top surface of the base to divide a space above the top surface into a first storage portion and a second storage portion.

3. The simple bin system of claim 1, wherein the base includes a bottom surface and shelf brackets attached to the bottom surface of the base, the shelf brackets configured to releasably couple the bottom surface of the simple bin to a set of mounts of a fabric sleeve.

4. The simple bin system of claim 1, further comprising:

a frame; and a fabric sleeve installed on the frame and comprising a plurality of compartments, the fabric sleeve further comprising one or more engagement tabs disposed within a first compartment of the plurality of compartments, wherein each compartment includes a set of mounts arranged to facilitate modular arrangement of bins;

wherein the simple bin is disposed in the first compartment, wherein the base is releasably coupled to the set of mounts of the first compartment, wherein the releasable fastener is engageable with the one or more engagement tabs of the first compartment to releasably close the simple bin and is disengageable by tilting the tiltable door to open the simple bin.

5. The simple bin system of claim 4, wherein the plurality of compartments of the fabric sleeve further comprises:

a second compartment having larger dimensions than the first compartment and configured to include a hanger rod and receive a hanger bin, wherein the second compartment also comprises the one or more engagement tabs; and/or a third compartment having smaller dimensions than the first compartment, the third compartment configured to receive at least a drawer bin.

6. The simple bin system of claim 5, wherein:

the first compartment has dimensions to receive a single simple bin;

the second compartment has dimensions equivalent to two simple bins; and the third compartment has dimensions to receive two drawer bins, wherein each of the first, the second, and the third compartment has a same width and depth.

7. The simple bin system of claim 4, wherein each of the one or engagement tabs comprises a magnetic coupler and a rigid plate, wherein each of the engagement tabs is configured to orient the magnetic coupler parallel to the tiltable door of the simple bin to facilitate engagement of the tiltable door when closed, and the rigid plate is orientated to provide structural support to the magnetic coupler.

8. The simple bin system of claim 4, wherein each of the one or more engagement tabs is a retractable element that comprises an adjustable strip to stow away a respective retractable engagement tab to create space to receive one or more drawer bins within the first compartment.

9. The simple bin system of claim 4, wherein the simple bin further comprises shelf brackets configured to releasably couple a bottom surface of the simple bin to the set of mounts of the fabric sleeve.

10. The simple bin system of claim 4, wherein each of the plurality of compartments is configured to receive a bin selected from a simple bin, a hanger bin, or a drawer bin, each bin comprising a door configured to remain within an interference zone proximate to a front side of the fabric sleeve when a respective bin is closed.

11. The simple bin system of claim 4, wherein the tiltable door is coupled to the fabric sleeve to limit an amount of opening of the simple bin.

12. A simple bin system including a simple bin, the system comprising:

a frame;

a fabric sleeve installed on the frame and comprising a plurality of compartments, the fabric sleeve further comprising one or more engagement tabs disposed within a first compartment of the plurality of compartments, wherein each compartment includes a set of mounts arranged to facilitate modular arrangement of bins;

a base including a front edge; and a tiltable door comprising:

a panel including a releasable fastener disposed along at least one side portion of the panel; and a bottom edge pivotably coupled along the front edge of the base, wherein the panel extends upward from the base; and collapsible connectors attached to and extending at least partially along opposite side portions of the panel toward the base, wherein in an open state, the panel is configured to partially tilt with respect to the base while the collapsible connectors limit tilting of the panel to a specified degree, and wherein in a closed state, the panel is configured to stay closed via the releasable fastener while the collapsible connectors are collapsed, wherein the simple bin is disposed in the first compartment, wherein the base is releasably coupled to the set of mounts of the first compartment, wherein the releasable fastener is engageable with the one or more engagement tabs of the first compartment to releasably close the simple bin and is disengageable by tilting the tiltable door to open the simple bin.

* * * * *